US008246417B2

(12) United States Patent
Kobayashi et al.

(10) Patent No.: US 8,246,417 B2
(45) Date of Patent: Aug. 21, 2012

(54) POLISHING APPARATUS AND POLISHING METHOD

(75) Inventors: Yoichi Kobayashi, Tokyo (JP); Yasumasa Hiroo, Tokyo (JP); Tsuyoshi Ohashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 649 days.

(21) Appl. No.: 12/310,877

(22) PCT Filed: Sep. 6, 2007

(86) PCT No.: PCT/JP2007/067771

§ 371 (c)(1),
(2), (4) Date: Mar. 11, 2009

(87) PCT Pub. No.: WO2008/032753

PCT Pub. Date: Mar. 20, 2008

(65) Prior Publication Data

US 2010/0029177 A1 Feb. 4, 2010

(30) Foreign Application Priority Data

Sep. 12, 2006 (JP) ..... 2006-246836

(51) Int. Cl.
*B24B 49/00* (2012.01)

(52) U.S. Cl. ..... 451/5; 451/6; 451/8; 451/288

(58) Field of Classification Search ..... 451/5, 6, 451/8, 285–290

See application file for complete search history.

(56) References Cited

U.S. PATENT DOCUMENTS 5,838,447 A * 11/1998 Hiyama et al. ..... 356/600
6,280,289 B1 * 8/2001 Wiswesser et al. ..... 451/6
6,296,548 B1 * 10/2001 Wiswesser et al. ..... 451/8
6,706,541 B1 3/2004 Toprac et al.
6,776,692 B1 8/2004 Zuniga et al.
7,226,337 B2 * 6/2007 David ..... 451/5

(Continued)

FOREIGN PATENT DOCUMENTS

| | | |
|---|---|---|
| JP | 2004/514273 | 5/2004 |
| WO | 02/10729 | 2/2002 |
| WO | 2005/123335 | 12/2005 |

OTHER PUBLICATIONS

International Search Report mailed Dec. 25, 2007 for International Application No. PCT/JP2007/067771.

*Primary Examiner* — Maurina Rachuba
(74) *Attorney, Agent, or Firm* — Wenderoth, Lind & Ponack, L.L.P.

(57) ABSTRACT

The present invention relates to a polishing apparatus and a polishing method for polishing a substrate, such as a semiconductor wafer, to planarize the substrate. The polishing apparatus according to the present invention includes a polishing table (10) having a polishing surface, a top ring (14) configured to press the substrate against the polishing table by applying pressing forces independently to first plural zones on the substrate, a sensor (50) configured to detect a state of the film at plural measuring points, a monitoring device (53) configured to produce monitoring signals with respect to second plural zones on the substrate, respectively, a storage device configured to store plural reference signals each indicating a relationship between reference values of each monitoring signal and polishing times, and a controller configured to operate the pressing forces against the first plural zones such that the monitoring signals, corresponding respectively to the second plural zones, converge on one of the plural reference signals.

16 Claims, 13 Drawing Sheets

U.S. PATENT DOCUMENTS

| | | | | |
|---|---|---|---|---|
| 7,822,500 | B2 * | 10/2010 | Kobayashi et al. | 700/108 |
| 2001/0036793 | A1 * | 11/2001 | Wiswesser et al. | 451/6 |
| 2002/0164925 | A1 * | 11/2002 | Swedek et al. | 451/5 |
| 2003/0045100 | A1 | 3/2003 | Saka et al. | |
| 2003/0176081 | A1 * | 9/2003 | Redeker et al. | 438/784 |
| 2004/0152396 | A1 * | 8/2004 | Wiswesser et al. | 451/6 |
| 2007/0243795 | A1 * | 10/2007 | Kobayashi et al. | 451/5 |
| 2010/0330878 | A1 * | 12/2010 | Kobayashi et al. | 451/5 |

* cited by examiner

| | D 2 | S | S | B | B |
|---|---|---|---|---|---|
| D 3 | u 3 \ D 4 | S | B | S | B |
| S | S | P B | P S | P S | P S |
| S | B | P S | Z R | Z R | N S |
| B | S | P S | Z R | Z R | N S |
| B | B | N S | N S | N S | N B |

| | | D 2 | S | S | B | B |
|---|---|---|---|---|---|---|
| T.p | D 3 | u 3 \ D 4 | S | B | S | B |
| S | S | S | P B | P B | P B | P B |
| S | S | B | P B | P S | P S | Z R |
| S | B | S | P B | P S | P S | Z R |
| S | B | B | Z R | Z R | Z R | N S |
| B | S | S | P S | Z R | Z R | Z R |
| B | S | B | Z R | N S | N S | N B |
| B | B | S | Z R | N S | N S | N B |
| B | B | B | N B | N B | N B | N B |

POLISHING APPARATUS AND POLISHING METHOD

TECHNICAL FIELD

The present invention relates to a polishing apparatus and a polishing method, and more particularly to a polishing apparatus and a polishing method for polishing a substrate, such as a semiconductor wafer, to planarize the substrate.

BACKGROUND ART

A polishing apparatus is used for polishing and planarizing a substrate such as a semiconductor wafer. There is known a polishing apparatus having a top ring with multiple chambers whose inner pressures are adjustable independently. In this type of polishing apparatus, a sensor measures a physical quantity associated with a thickness of a film on a substrate, and a monitoring signal is produced based on the physical quantity. Prior to polishing of the substrate, a reference signal that indicates a relationship between the monitoring signal and times is prepared in advance. During polishing of the substrate, pressing forces of the top ring are adjusted such that monitoring signals, obtained at plural measuring points on the substrate, converge on the reference signal, whereby a uniform film thickness can be realized over a surface of the substrate (for example, see WO 2005/123335).

However, in the conventional polishing apparatus, a sensor signal value, obtained at a certain zone of a substrate, may greatly differ from sensor signal values obtained at other zones. This is problematic in evaluating a film thickness correctly by the sensor. One of causes of this problem is signal drop due to an effective measuring range of the sensor. The effective measuring range of the sensor necessarily has a certain dimension. Consequently, when the sensor is measuring a periphery of a wafer, part of the effective measuring range of the sensor protrudes from a surface of the wafer and the sensor cannot obtain accurate signals. In such a case, it is possible to exclude the measuring points where the accurate signals cannot be obtained. However, in a case where the uniformity of the film thickness in the periphery of the wafer is of especial importance, this method cannot be used.

Another cause is an influence of metal or magnetic material in the top ring. If a conductive metal (e.g., SUS) or a magnetic material is used in the top ring, the sensor signal value can be locally changed by the influence of such a material.

SUMMARY OF INVENTION

The present invention has been made in view of the above drawbacks. It is therefore an object of the present invention to provide a polishing apparatus and a polishing method capable of accurately controlling a film-thickness profile of a polished substrate.

In order to achieve the above object, according to one aspect of the present invention, there is provided a polishing apparatus for polishing a substrate having a film formed on a surface thereof. The apparatus includes: a polishing table having a polishing surface; a top ring configured to press the substrate against the polishing table by applying pressing forces independently to first plural zones on the substrate; a sensor configured to detect a state of the film at plural measuring points; a monitoring device configured to produce monitoring signals for second plural zones on the substrate, respectively, from an output signal of the sensor; a storage device configured to store plural reference signals each indicating a relationship between reference values of each monitoring signal and polishing times; and a controller configured to operate the pressing forces against the first plural zones such that the monitoring signals, corresponding respectively to the second plural zones, converge on one of the plural reference signals.

In a preferred aspect of the present invention, one of the second plural zones is a zone including a peripheral zone of the substrate; and one of the plural reference signals is a reference signal with respect to the zone including the peripheral zone of the substrate.

In a preferred aspect of the present invention, the plural reference signals are defined so as to correspond to the second plural zones, respectively.

In a preferred aspect of the present invention, values of the monitoring signals and values of the reference signals are converted into values associated with a polishing time based on the reference signals so that new monitoring signals and new reference signals are produced.

In a preferred aspect of the present invention, an average of the new monitoring signals with respect to the second plural zones are calculated at a certain time in polishing of the substrate, and the new reference signal after that time is translated along a temporal axis such that the new reference signal at that time coincides with the average.

In a preferred aspect of the present invention, the plural reference signals correspond to the same film thickness at the same point in time.

In a preferred aspect of the present invention, the plural reference signals correspond to film thicknesses each reflecting a predetermined film-thickness difference between the second plural zones.

In a preferred aspect of the present invention, a control period of the controller is in a rage of 1 second to 10 seconds.

In a preferred aspect of the present invention, the sensor comprises an eddy current sensor.

In a preferred aspect of the present invention, the controller is configured to detect a polishing end point based on the monitoring signals produced by the monitoring device.

Another aspect of the present invention is to provide a polishing method for polishing a substrate by applying pressing forces independently to first plural zones on the substrate to press the substrate against a polishing table. The method includes: defining plural reference signals each indicating a relationship between reference values of each monitoring signal and polishing times, the monitoring signal being associated with a thickness of a film on the substrate; detecting a state of the film at plural measuring points using a sensor; from an output signal of the sensor, producing monitoring signals for second plural zones on the substrate, respectively; and operating the pressing forces against the first plural zones such that the monitoring signals, corresponding to the second plural zones, converge on one of the plural reference signals.

In a preferred aspect of the present invention, the defining of the plural reference signals includes: preparing a reference substrate equivalent to the substrate to be polished; measuring a thickness of a film on the reference substrate; during polishing of the reference substrate, detecting a state of the film on the reference substrate at the plural measuring points by the sensor; from the output signal of the sensor, producing monitoring signals for a first zone and a second zone selected from the second plural zones; stopping polishing of the reference wafer when the film in the first zone and the second zone is completely removed; calculating average polishing rates in the first zone and the second zone; expanding or compressing the monitoring signal for the second zone along a temporal axis such that the average polishing rate in the second zone is equal to the average polishing rate in the first zone; calculating a polishing time required for aligning an initial film thickness in the second zone with an initial film thickness in the first zone; translating the expanded or compressed monitoring signal for the second zone along the temporal axis by the polishing time calculated; and assigning the translated monitoring signal as a reference signal for the second zone.

According to the present invention, the plural reference signals are provided for the plural zones on the substrate. Accordingly, a uniform film thickness can be obtained in all of the zones on the substrate. In addition, there is no need to locate the sensor close to the surface of the substrate in order to reduce the effective measuring range of the sensor. Consequently, a normal polishing pad with no through-hole or a dent on a rear surface thereof can be used.

DETAILED DESCRIPTION OF THE INVENTION

An Embodiment of the present invention will be described below with reference to FIG. 1 through FIG. 24.

Figure 1:
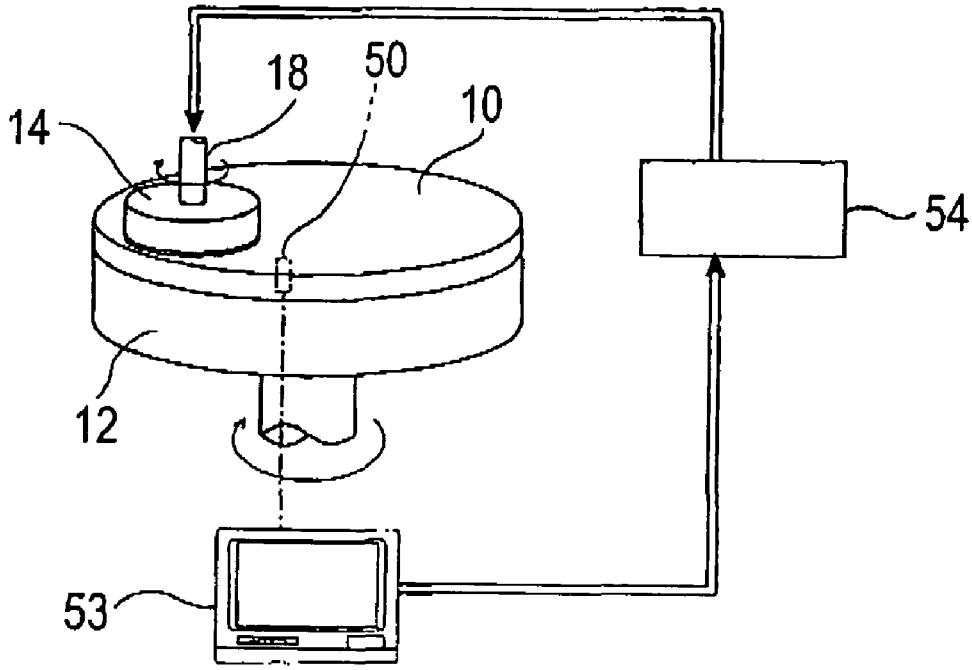
FIG. 1 is a schematic view showing a whole structure of a polishing apparatus according to an embodiment of the present invention.

FIG. 1 is a schematic view showing a whole structure of a polishing apparatus according to an embodiment of the present invention. As shown in FIG. 1, the polishing apparatus has a polishing table 12 supporting a polishing pad 10 attached to an upper surface thereof, and a top ring 14 configured to hold a wafer, which is a workpiece to be polished, and to press the wafer against an upper surface of the polishing pad 10. The upper surface of the polishing pad 10 provides a polishing surface with which the wafer is brought into sliding contact.

The polishing table 12 is coupled to a motor (not shown in the drawing) disposed therebelow, and is rotatable about its own axis as indicated by arrow. A polishing liquid supply nozzle (not shown in the drawing) is disposed above the polishing table 12, so that a polishing liquid is supplied from the polishing liquid supply nozzle onto the polishing pad 10.

The top ring 14 is coupled to a top ring shaft 18, which is coupled to a motor and an elevating cylinder (not shown in the drawing). The top ring 14 can thus be vertically moved and rotated about the top ring shaft 18. The wafer to be polished is attracted to and held on a lower surface of the top ring 14 by a vacuum suction or the like.

With the above-described structures, the wafer, held on the lower surface of the top ring 14, is rotated and pressed by the top ring 14 against the polishing surface of the polishing pad 10 on the rotating polishing table 12. The polishing liquid is supplied from the polishing liquid supply nozzle onto the polishing surface of the polishing pad 10. The wafer is polished in the presence of the polishing liquid between the surface (lower surface) of the wafer and the polishing pad 10.

Figure 2:
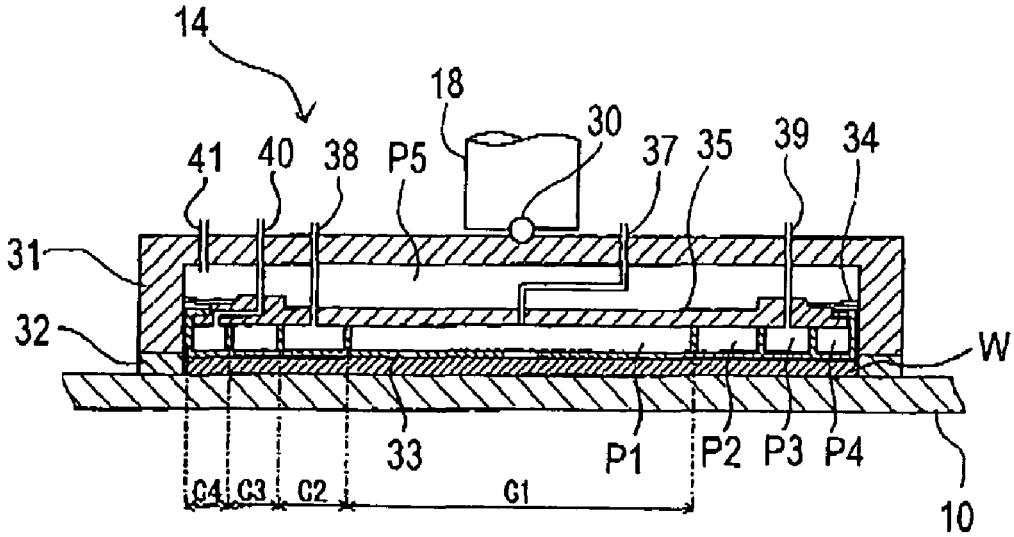
FIG. 2 is a schematic view showing a cross section of a top ring shown in FIG. 1.

FIG. 2 is a schematic view showing a cross section of the top ring shown in FIG. 1. As shown in FIG. 2, the top ring 14 has a disk-like top ring body 31 coupled to a lower end of the top ring shaft 18 via a flexible joint 30, and a retainer ring 32 provided on a lower portion of the top ring body 31. The top ring body 31 is made of a material having high strength and rigidity, such as metal or ceramic. The retainer ring 32 is made of highly rigid resin, ceramic, or the like. The retainer ring 32 may be formed integrally with the top ring body 31.

The top ring body 31 and the retainer ring 32 form therein a space, which houses an elastic pad 33 to be brought into contact with the wafer W, an annular pressure sheet 34 made from an elastic membrane, and a substantially disk-shaped chucking plate 35 configured to hold the elastic pad 33. The elastic pad 33 has an upper peripheral edge, which is held by the chucking plate 35. Four pressure chambers (air bags) P1, P2, P3, and P4 are provided between the elastic pad 33 and the chucking plate 35. A pressurized fluid (e.g., a pressurized air) is supplied into the pressure chambers P1, P2, P3, and P4 or a vacuum is developed in the pressure chambers P1, P2, P3, and P4 via fluid passages 37, 38, 39, and 40, respectively. The center pressure chamber P1 has a circular shape, and the other pressure chambers P2, P3, and P4 have an annular shape. These pressure chambers P1, P2, P3, and P4 are in a concentric arrangement.

A pressure-adjusting device (not shown in the drawing) is provided so as to change internal pressures of the pressure chambers P1, P2, P3, and P4 independently of each other to thereby substantially independently adjust pressing forces to be applied to four zones: a central zone C1, an inner middle zone C2, an outer middle zone C3, and a peripheral zone C4 (To be exact, each zone is more or less affected by the pressure chamber corresponding to the other zone, e.g., the adjacent zone). Further, by elevating or lowering the top ring 14 in its entirety, the retainer ring 32 can be pressed against the polishing pad 10 at a predetermined pressing force. A pressure chamber P5 is formed between the chucking plate 35 and the top ring body 31. A pressurized fluid is supplied into the pressure chamber P5 or a vacuum is developed in the pressure chamber P5 via a fluid passage 41. With this operation, the chucking plate 35 and the elastic pad 33 in their entirety can be moved vertically. The retainer ring 32 is arranged around the wafer W so as to prevent the wafer W from coming off the top ring 14 during polishing.

As shown in FIG. 1, a sensor 50 for monitoring (i.e., detecting) a state of a film on the wafer W is provided in the polishing table 12. This sensor 50 is coupled to a monitoring device 53, which is couple to a CMP controller 54. An eddy current sensor can be used as the sensor 50. An output signal of the sensor 50 is sent to the monitoring device 53. This monitoring device 53 performs necessary conversions and processing (calculations) on the output signal (sensing signal) of the sensor 50 to produce a monitoring signal.

The monitoring device 53 also functions as a controller for operating the internal pressures of the pressure chambers P1, P2, P3, and P4 based on the monitoring signals. Specifically, the monitoring device 53 determines the pressing forces of the top ring 14 against the wafer W based on the monitoring signals. The determined pressing forces are sent to the CMP controller 54. The CMP controller 54 commands the non-illustrate pressure-adjusting device to change the pressing forces of the top ring 14 against the wafer W. The monitoring device 53 and the CMP controller 54 may be integrated into a single control device.

Figure 3:
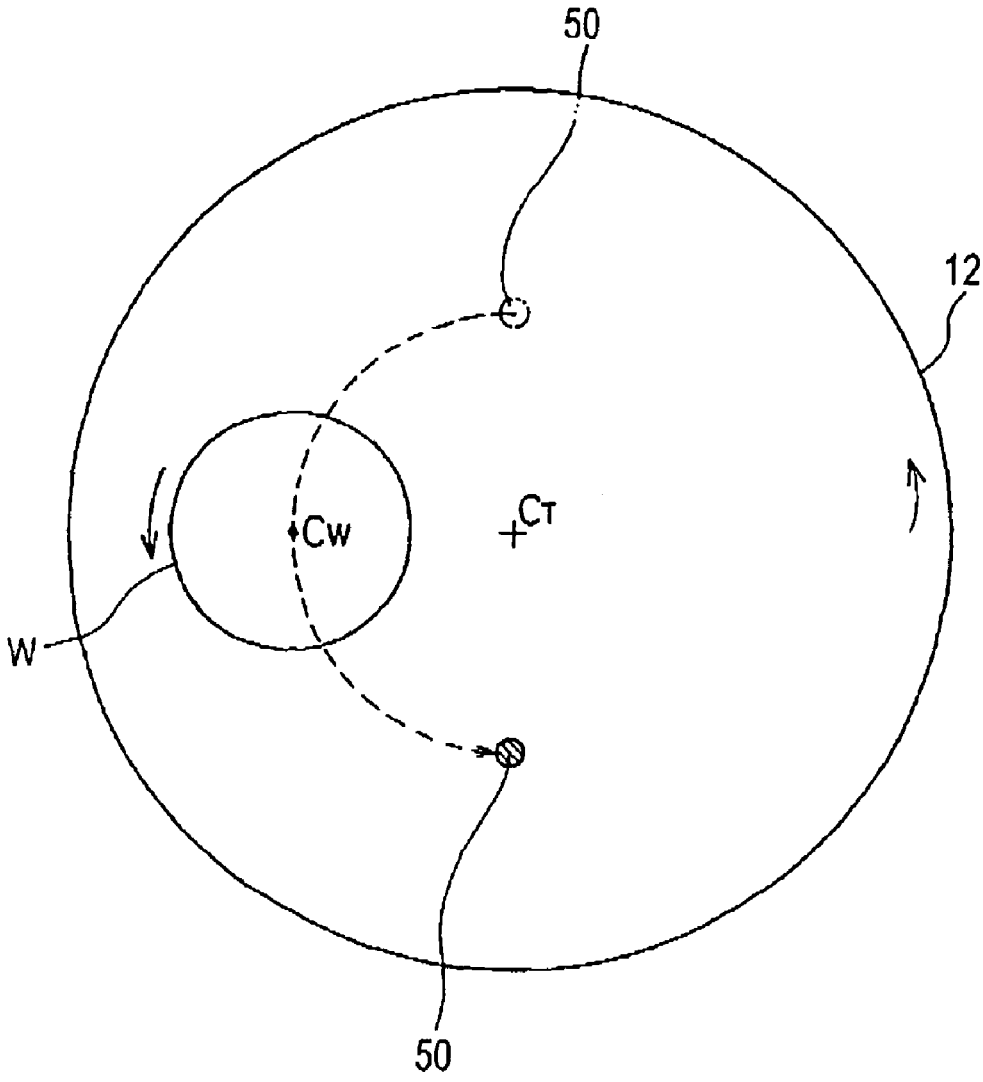
FIG. 3 is a plan view showing a positional relationship between a polishing table and a wafer.

FIG. 3 is a plan view showing a positional relationship between the polishing table 12 and the wafer W. As shown in FIG. 3, the sensor 50 is arranged in a location such that the sensor 50 passes through a center $C_w$ of the wafer W, held by the top ring 14, during polishing. A symbol CT is a center of rotation of the polishing table 12. While moving under the wafer W, the sensor 50 measures a thickness of a conductive film (e.g., a Cu layer) or a quantity that increases or decreases in accordance with a change in film thickness. The sensor 50 obtains measurements continuously along a path of its movement (i.e., a scan line).

Figure 4:
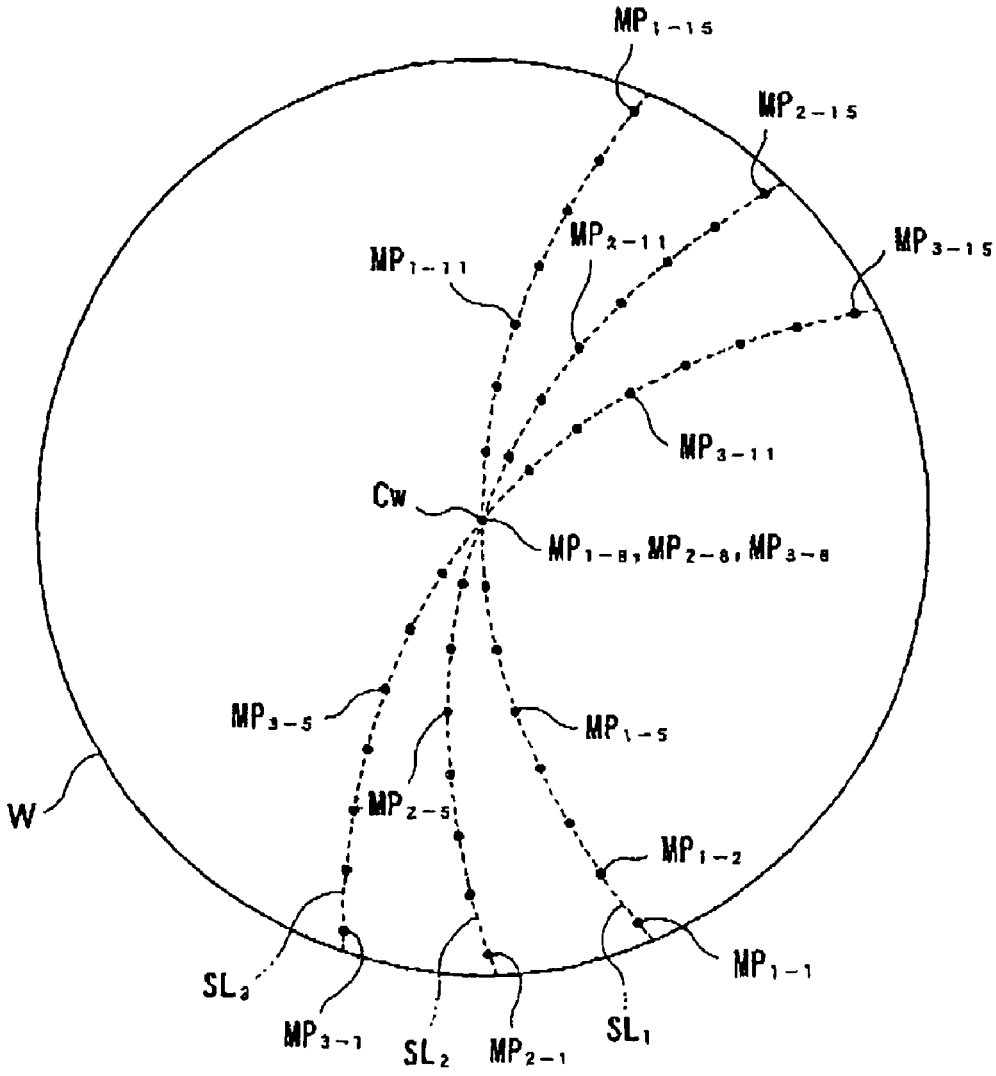
FIG. 4 is a view showing paths of a sensor sweeping across the wafer.

FIG. 4 is a view showing paths of the sensor 50 sweeping across the wafer W. The sensor 50 sweeps across the surface (that is being polished) of the wafer W each time the polishing table 12 makes one revolution. Specifically, when the polishing table 12 is being rotated, the sensor 50 sweeps across the surface of the wafer W in a path passing through the center $C_w$ of the wafer W (center of the top ring shaft 18). A rotational speed of the top ring 14 is generally different from a rotational speed of the polishing table 12. Therefore, the path of the sensor 50 described on the surface of the wafer W changes as the polishing table 12 rotates, as indicated by scan lines $SL_1$, $SL_2$, $SL_3$, . . . in FIG. 4. Even in this case, since the sensor 50 is located so as to move through the center $C_w$ of the wafer W as described above, the path of the sensor 50 passes through the center $C_w$ of the wafer W in every rotation. In this embodiment, measuring timings of the sensor 50 are adjusted so that the film thickness at the center $C_w$ of the wafer W is always measured by the sensor 50 in every rotation.

It is known that a film-thickness profile of the polished wafer W is substantially axisymmetric with respect to an axis that extends through the center $C_w$ of the wafer W in a direction perpendicular to the surface of wafer W. Accordingly, as shown in FIG. 4, where an n-th measuring point on an m-th scan line $SL_m$ is represented by $MP_{m-n}$, the change in the film thickness of the wafer W at n-th measuring points, which define a radial position, can be monitored by tracking the monitoring signals obtained at the n-th measuring points $MP_{1-n}$, $MP_{2-n}$, . . . , $MP_{m-n}$ on respective scan lines.

In FIG. 4, for the sake of simplification, the number of measuring points in one scanning operation is set to 15. However, the number of measuring points is not limited to the illustrated example and various numbers can be set in accordance with a period of measuring operation and the rotational speed of the polishing table 12. When using an eddy current sensor as the sensor 50, no less than one hundreds of measuring points are generally set on one scan line. When a large number of measuring points are set in this manner, one of them substantially coincides with the center $C_w$ of the wafer W. Therefore, it is not necessary in this case to adjust the measuring timings with respect to the center $C_w$ of the wafer W.

Figure 5:
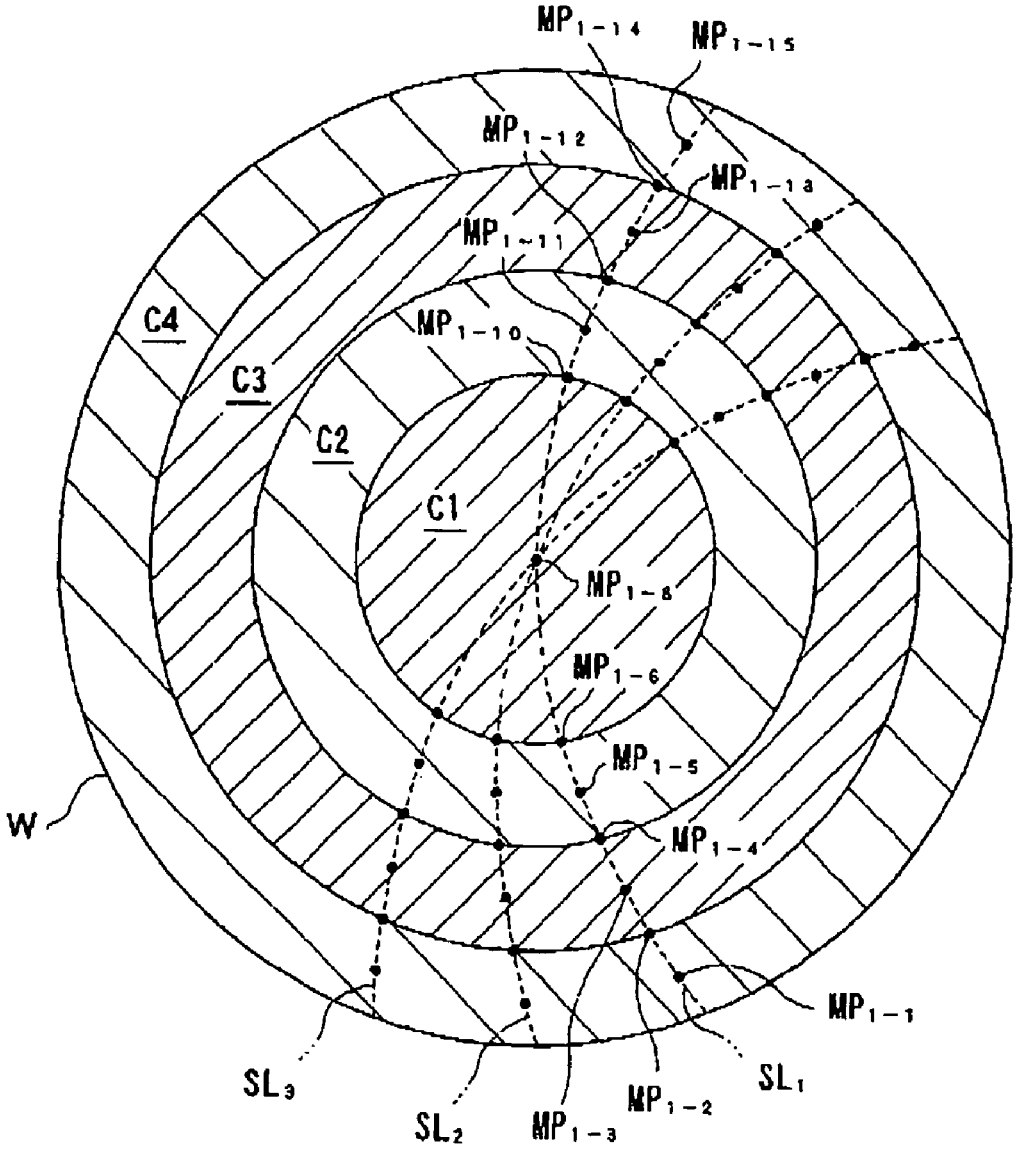
FIG. 5 is a plan view showing an example of selecting measuring points to be monitored by a monitoring device, among measuring points on the wafer shown in FIG. 4.

FIG. 5 is a plan view showing an example of selecting the measuring points to be monitored by the monitoring device 53, among the measuring points on the wafer W shown in FIG. 4. In the example shown in FIG. 5, the monitoring device 53 monitors the measuring points $MP_{m-1}$, $MP_{m-2}$, $MP_{m-3}$, $MP_{m-4}$, $MP_{m-5}$, $MP_{m-6}$, $MP_{m-8}$, $MP_{m-10}$, $MP_{m-11}$, $MP_{m-12}$, $MP_{m-13}$, $Mp_{m-14}$, and $MP_{m-15}$ located near centers and boundaries of the zones C1, C2, C3, and C4 to which the pressing forces are applied independently. An additional measuring point may be provided between the measuring points $MP_{m-i}$ and $MP_{m-(i+1)}$, unlike the example shown in FIG. 4. Selecting of the measuring points to be monitored is not limited to the example shown in FIG. 5. Any point to be observed in view of polishing control of the surface of the wafer W can be selected as the measuring point to be monitored. All of the measuring points on each scan line can be selected.

The monitoring device 53 performs certain calculations on the output signal (sensing signal) of the sensor 50 obtained at the selected measuring points to produce the monitoring signals. Based on the monitoring signals and below-described reference signals, the monitoring device 53 calculates the internal pressures of the pressure chambers P1, P2, P3, and P4 in the top ring 14 corresponding to the respective zones C1, C2, C3, and C4. More specifically, the monitoring device 53 compares the monitoring signals, obtained at the selected measuring points, with the reference signals set in advance for the respective measuring points, and calculates optimum pressures in the pressure chambers P1, P2, P3, and P4 that can allow the respective monitoring signals to converge on the corresponding reference signals. The calculated pressure values are sent from the monitoring device 53 to the CMP controller 54, and the CMP controller 54 changes the pressures in the pressure chambers P1, P2, P3, and P4. In this manner, the pressing forces against the respective zones C1, C2, C3, and C4 of the wafer W are adjusted.

In order to eliminate noises so as to smoothen data, an average of the monitoring signals, obtained at neighboring measuring points, may be used. Alternatively, it is possible to calculate an average or a representative value of the monitoring signals obtained at the measuring points in each of the concentric zones which are divided according to the radial position from the center $C_w$ of the surface of the wafer W. In this case, the average or representative value can be used as a new monitoring signal for control. A distance of each measuring point from the center $C_w$ of the wafer W may be determined at each point of time during polishing, so that each measuring point is assigned to the proper zone based on the distance from the center $C_w$ of the wafer W. This operation is effective in a case where plural sensors are arranged along the radial direction of the polishing table 12 and in a case where the top ring 14 is configured to swing around the top ring head shaft 18. Each of the measuring points actually has a certain area corresponding to the effective measuring range of the sensor. Therefore, in all cases described above, it can be said that the monitoring signal shows a state of plural regions on the substrate.

Figure 6:
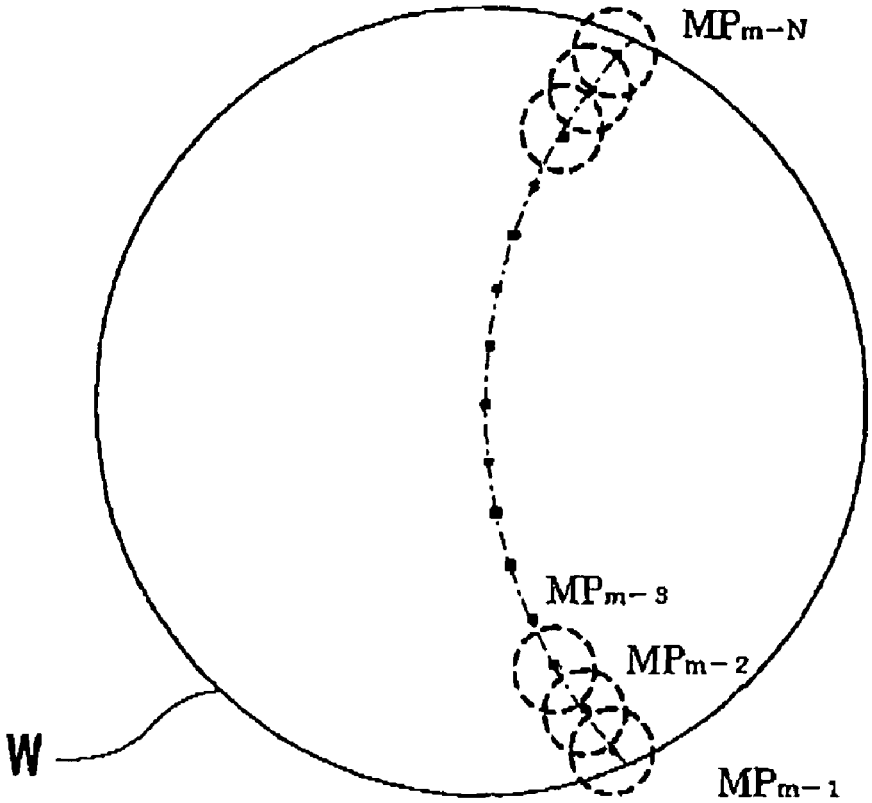
FIG. 6 is a view showing an effective measuring range of the sensor at the measuring points.
Figure 7:
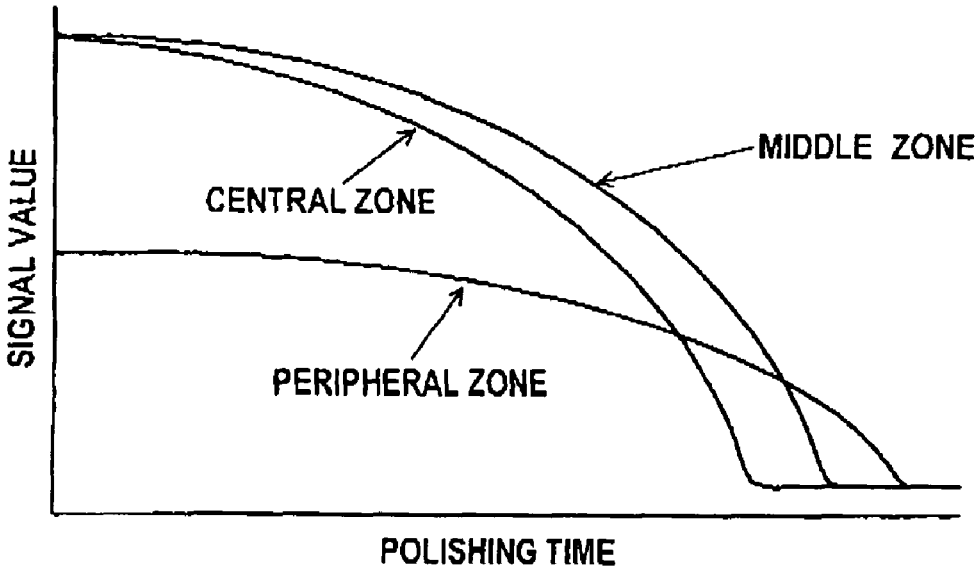
FIG. 7 is a graph showing signals obtained in respective zones on the wafer.

FIG. 6 is a view showing the effective measuring range of the sensor at the measuring points. When the eddy current sensor is used as the sensor 50, the effective measuring range on the wafer W is determined by a size of a coil in the sensor 50, an effective spread angle, and a distance from the sensor 50 to the wafer W. The sensor 50 obtains information within an area shown by a dotted line in FIG. 6 at each measuring point. However, when the sensor 50 is measuring the state of the peripheral zone of the wafer W, part of the effective measuring range of the sensor 50 protrudes from the surface of the wafer W (see the measuring points $MP_{m-1}$, and $MP_{m-N}$ in FIG. 6). In such a case, as shown in FIG. 7, the monitoring signals, corresponding to the measuring points $MP_{m-1}$, and $MP_{m-N}$ at the peripheral zone of the wafer W, greatly differ from the monitoring signals in other zones. This is problematic in evaluating the film thickness correctly. Similar problems can arise when using a sensor other than the eddy current sensor, under some conditions. In FIG. 7, a point where each monitoring signal, which is in a downward trend, becomes constant at the final stage of the polishing time indicates a polishing end point (i.e., a point of time when a metal film is completely removed).

This embodiment provides a solution to the problem in which the monitoring signal value in a certain zone of the wafer W differs from the other despite the same film thickness. Specifically, reference signals are provide for the zones C1 to C4 of the wafer W, respectively. These reference signals are values (reference values) as indexes of the monitoring signals at each time (each polishing time) for realizing a desired film-thickness profile (e.g., a profile with a uniform thickness of a polished film). Each reference signal can be expressed as a graph indicating a relationship between a polishing time and a desired value of the monitoring signal at the corresponding polishing time. In this embodiment, a reference wafer, which is equivalent to a target wafer to be polished, is polished in advance. Based on the monitoring signals obtained during polishing of the reference wafer, the reference signals are produced for the respective zones C1 to C4 distributed along the radial direction of the wafer W.

When the pressing forces against the respective zones are operated so as to make the film thickness uniform along the radial direction of the wafer, the reference signals to be set for the respective zones must be signals each corresponding to the same film thickness at the same point in time. Specifically, the wafer W can be polished to have a uniform film thickness in all zones by preparing the reference signals which are regarded as corresponding to the same film thickness at the same point in time and operating the pressing forces such that the monitoring signals, obtained in the respective zones, converge on the respective reference signals.

Figure 8:
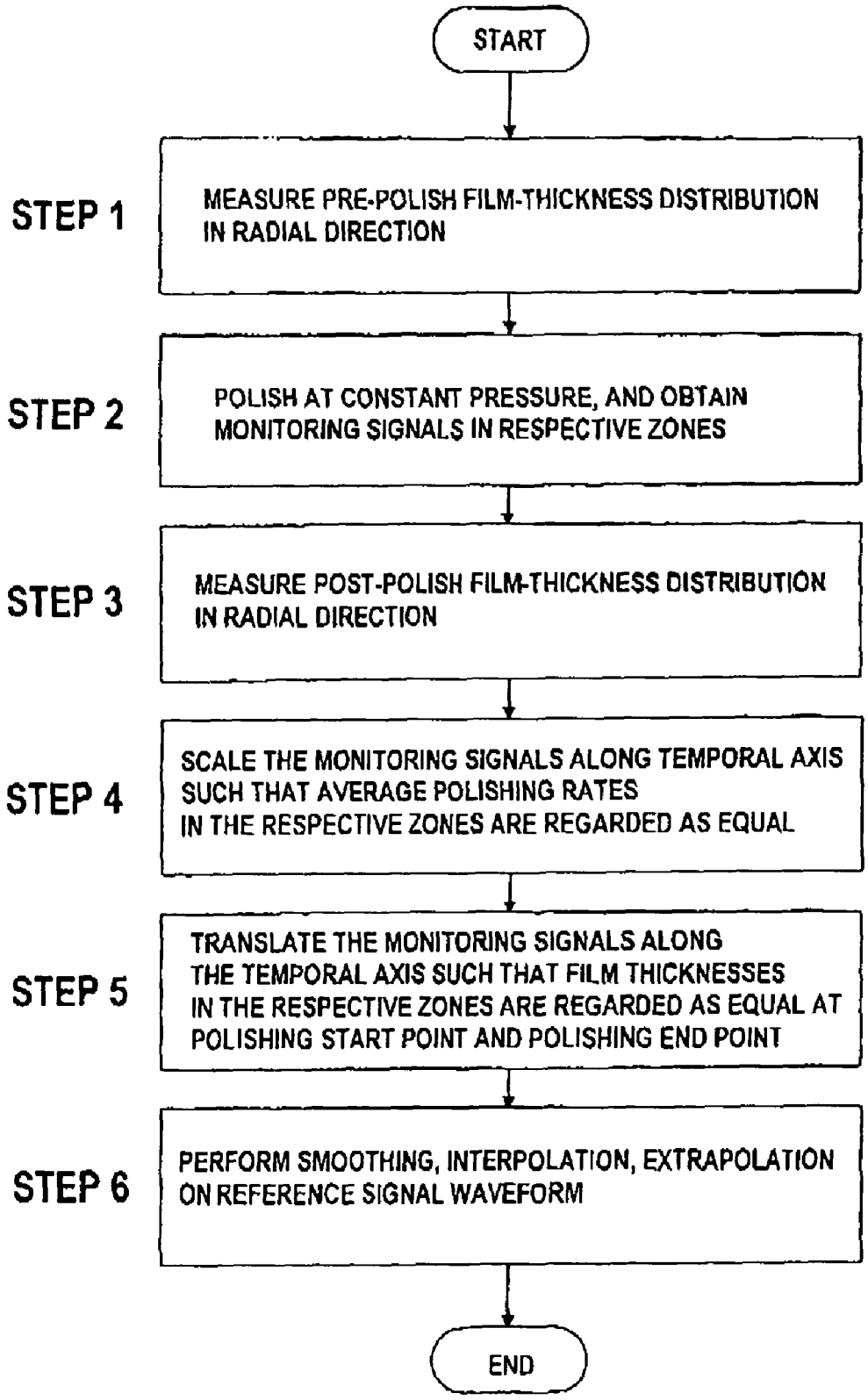
FIG. 8 is a flow diagram showing a sequence of steps for producing reference signals for the respective zones based on corresponding monitoring signals obtained during polishing of a reference wafer.

FIG. 8 is a flow diagram showing a sequence of steps for producing the reference signals for the respective zones based on the corresponding monitoring signals obtained during polishing of the reference wafer. First, the reference wafer is prepared. This reference wafer is a wafer that is equivalent to the target wafer (an object of polishing). Next, as shown in FIG. 8, a film thickness distribution along the radial direction of the reference wafer is measured prior to polishing of the reference wafer, so that pre-polish representative film thicknesses in the respective zones C1 to C4 are obtained (STEP 1). The equivalent wafer is such that a polishing rate (a removal rate) at each time during polishing is substantially equal to that of the target wafer, the monitoring signals obtained at the same film thickness are substantially equal to those of the target wafer, and a film formation range in a peripheral zone is substantially equal to that of the target wafer. For example, in a case of using an eddy current sensor, a material of a film (a metal film to be polished) of the reference wafer should be basically the same kind of the film of the target wafer. Further, if the target wafer itself has a considerably small resistance compared with the metal film and potentially affects the monitoring signals during polishing, a resistance of the reference wafer is required to be substantially equal to the resistance of the target wafer. However, it is not necessary that the reference wafer be not strictly identical the target wafer. For, example, in a case where a polishing rate of the reference wafer is greatly different from the polishing rate of the target wafer, the reference wafer can be used for a polishing control of the target wafer by scaling up or down (i.e., expanding or compressing) the monitoring signals, obtained during polishing of the reference wafer, along a temporal axis so as to adjust an apparent polishing rate. In terms of securing a sufficient control time, an initial film thickness of the reference wafer is preferably equal to or larger than an initial film thickness of the target wafer. However, even if the initial film thickness of the reference wafer is smaller than the initial film thickness of the target wafer, it is still possible to use such reference wafer for the polishing control by shortening a control time which will be described later.

After the film thickness distribution of the reference wafer is obtained, this reference wafer is polished, so that the monitoring signals with respect to the zones C1 to C4 are obtained (STEP 2). During polishing of the reference wafer, the pressures in the pressure chambers P1, P2, P3, and P4 corresponding respectively to the zones C1, C2, C3, and C4 are kept constant (i.e., unchanged). However, it is not necessary to make the pressures in the pressure chambers P1, P2, P3, and P4 equal to each other. During polishing of the reference wafer, other polishing conditions (e.g., the polishing pad 10, the polishing liquid, the rotational speed of the polishing table 12, the rotational speed of the top ring 14) are basically kept constant. Preferably, the polishing conditions during polishing of the reference wafer are set to be identical or similar to the polishing conditions during polishing of the target wafer.

After a predetermined period of time has elapsed, polishing of the reference wafer is stopped. Then, the thickness of the film on the polished reference wafer is measured, so that post-polish representative film thicknesses in the zones C1 to C4 are obtained (STEP 3). When a metal film is a target film to be polished, polishing of the reference wafer is stopped before the metal film is removed. This is because of ensuring measuring of the film thickness by the sensor 50 after polishing. Another reason is that the removal of the metal film causes a great change in the polishing rate, making it difficult to obtain accurate reference signals. It is possible to determine a time of the removal of the metal film in each zone of the wafer W based on the monitoring signal and to produce the reference signal that is adjusted so as to show zero as a value of the film thickness at the time of the metal-film removal. In this case, the reference wafer is polished until the metal film is completely removed.

As will be described later, in this embodiment, certain processes, such as scaling and parallel translation, are performed on the monitoring signals obtained with respect to the respective zones of the reference wafer so as to produce the reference signals indicating the same film thickness at the same point in time in the respective zones. Therefore, the reference wafer to be polished is not required to have a uniform film thickness. However, the sensor is likely to fail to grasp a film-thickness profile with a steep shape. Therefore, it is preferable that the reference wafer have a uniform film thickness along the radial direction thereof before and after polishing. The more uniform the film thickness is, the more accurate the reference signals are expected to be.

Figure 9A:
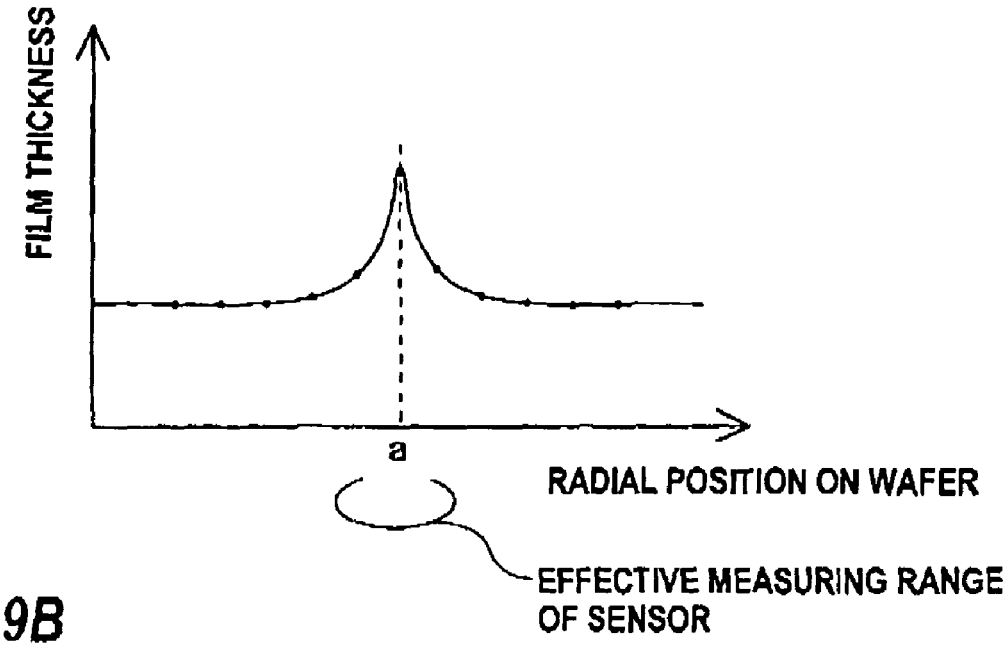
FIG. 9A and FIG. 9B are schematic views each showing an example of a film-thickness distribution.
Figure 9B:
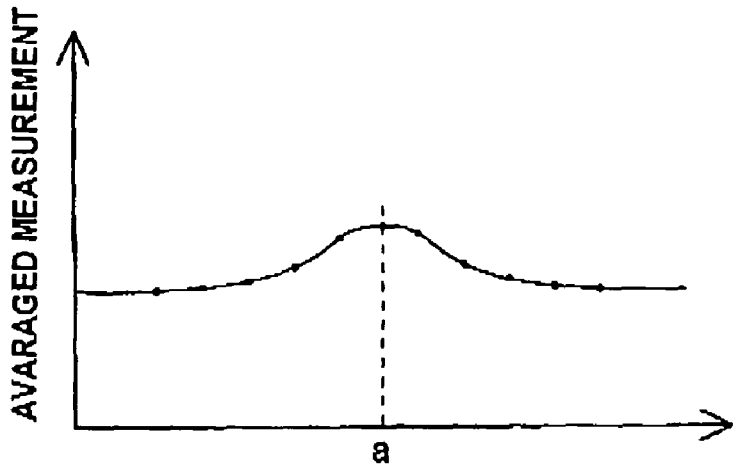

A film-thickness profile of the wafer may have locally-formed concavity and convexity. If the concavity and convexity are small in size than the effective measuring range of the sensor, the sensor cannot generate an output signal reflecting shapes of the concavity and convexity correctly. In an example shown in FIG. 9A, a film on a wafer has a steep convexity at a point α. Since the effective measuring range of the sensor has a certain dimension, the sensor does not produce an output signal corresponding to a film thickness of a peak in the convexity, but produces an output signal corresponding to an average film thickness within the effective measuring range. Thus, in film-thickness measuring operations before and after polishing of the reference wafer, it is preferable to calculate an average of measurements obtained in an area corresponding to the effective measuring range of the sensor 50 and define the average as the film thickness at a center of the area. FIG. 9B shows a film-thickness distribution thus obtained. In FIG. 9A and FIG. 9B, black spots on a graph show the measuring points of the sensor 50.

Next, in STEP 4 and STEP 5 (see FIG. 8), the reference signals are corrected such that all of the reference signals can be regarded as corresponding to the same film thickness at the same point in time.

Figure 10:
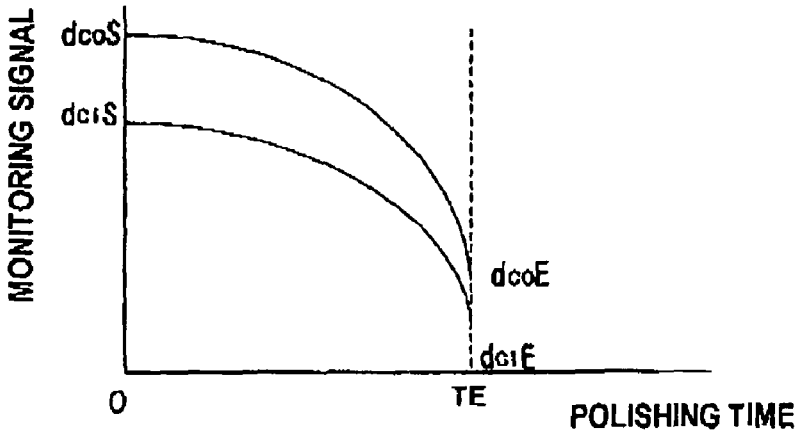
FIG. 10 shows an example of the monitoring signal obtained during polishing of the reference wafer.

FIG. 10 shows an example of the monitoring signal obtained when polishing the reference wafer. Generally, the value of the monitoring signal (and the sensor signal) does not indicate a film thickness itself. However, there is a relationship between the value of the monitoring signal and the film thickness. However, as described above, even when the film thickness is uniform, the monitoring signal for the peripheral zone of the wafer W may indicate a smaller value than that for the other zone of the wafer. Moreover, because of the influence of a conductive material or the like, the monitoring signal may not indicate a value that is to be obtained originally. Thus, the pre-polish film thicknesses and the post-polish film thicknesses, obtained in STEP 1 and STEP 3, are assigned to the monitoring signals, so that the monitoring signals and the film thicknesses are associated with each other. Specifically, as shown in FIG. 10, a pre-polish film thickness $d_{C0}S$ and a post-polish film thickness $d_{C0}E$ in a reference zone C0 are assigned respectively to a start point and an end point of the monitoring signal of the reference zone C0. Similarly, a pre-polish film thickness $d_{Ci}S$ and a post-polish film thickness $d_{Ci}E$ in a zone Ci, other than the reference zone C0, are assigned respectively to a start point and an end point of the monitoring signal of the zone Ci. As an example, the zone C1, which includes the center of the wafer, can be selected as the reference zone C0.

Figure 11:
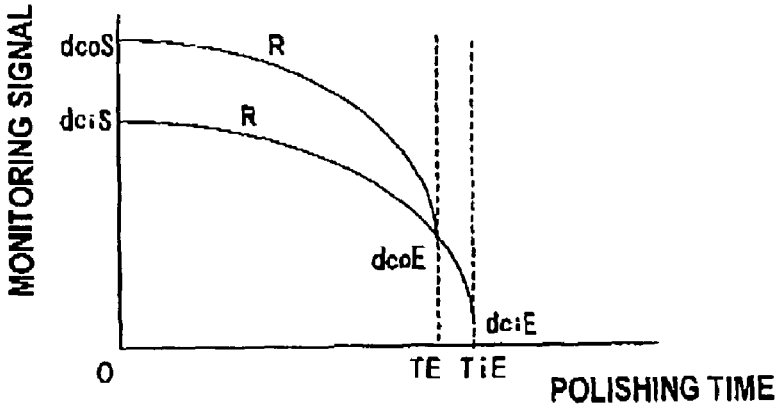
FIG. 11 is a diagram illustrating scaling of the monitoring signal with respect to a temporal axis.

FIG. 11 is a diagram illustrating scaling of the monitoring signal with respect to the temporal axis. In STEP 4, scaling of the monitoring signal along the temporal axis is performed such that average polishing rates in the respective zones C1 to C4 become equal to each other. The scaling process in this specification is to expand or compress the monitoring signal along the temporal axis.

Where a polishing time of the reference wafer is TE, an average polishing rate R in the reference zone C0 is given by the following equation (1).

$$R=(d_{C0}S-d_{C0}E)/TE \quad (1)$$

In order to make the average polishing rate in the zone Ci equal to the average polishing rate in the reference zone C0, a correction polishing time TiE with respect to the zone Ci is calculated as follows.

$$TiE=(d_{Ci}S-d_{Ci}E)/R \quad (2)$$

Where a polishing start time is zero, a time ti corresponding to each value of the monitoring signal in the zone Ci is corrected by the following expression (3).

$$ti \leftarrow ti \times TiE/TE \quad (3)$$

In the above expression (3), a symbol "←" represents substitution.

The example in FIG. 11 shows a case where $d_{Ci}S-d_{Ci}E>d_{C0}S-d_{C0}E$.

Figure 12:
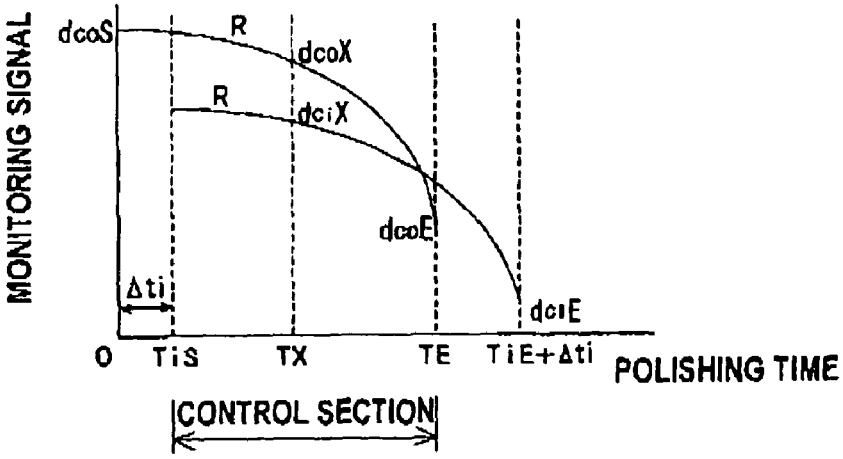
FIG. 12 is a diagram illustrating parallel translation of the monitoring signal, which has been scaled, along the temporal axis.

The monitoring signal is thus scaled up or down along the temporal axis. Then, the monitoring signal is further translated in parallel to the temporal axis. FIG. 12 is a diagram illustrating the parallel translation of the monitoring signal along the temporal axis and showing STEP 5 in FIG. 8. In STEP 5, the initial film thicknesses in the respective zones are aligned.

Assume that the polishing rates in the respective zones C1 to C4 are approximately constant at each time during polishing of the reference wafer. In this condition, a polishing time Δti, which is required to polish the reference wafer until the initial film thickness $d_{C0}S$ in the reference zone C0 coincides with the initial film thickness $d_{Ci}S$ in the zone Ci, is given by the following expression (4).

$$\Delta ti=(d_{C0}S-d_{Ci}S)/R \quad (4)$$

Then, the polishing time ti, corrected by the expression (3), is further corrected by using the following expression (5).

$$ti \leftarrow ti+\Delta ti \quad (5)$$

In the example shown in FIG. 12, each value of the monitoring signal for the zone Ci is translated along the temporal axis by Δti. As a result, the film thickness in the zone C0 and the film thickness in the zone Ci at the time TiS (which is the start point of the monitoring signal with respect to the zone Ci) can be regarded as equal to each other. Further, since the average polishing rate in the zone C0 and the average polishing rate in the zone Ci are equal to each other, film thicknesses at the time TE can also be regarded as equal to each other. Therefore, the film thicknesses $d_{C0}X$ and $d_{C1}X$ at a certain time TX ($TiS \leqq TX \leqq TE$) can be regarded as equal to each other.

In this manner, the monitoring signal obtained in the zone Ci is scaled and translated along the temporal axis. As a result, the monitoring signal for the zone C0 and the corrected monitoring signal for the zone Ci coexist only in a section between Max(0, TiS) and Min (TE, TiE+Δti), where Max represents a larger one of values in a parenthesis and Min represents a smaller one of values in a parenthesis. While FIG. 12 shows an example of the case where the value $d_{C0}S$ is larger than the value $d_{Ci}S$, there is also a case where the value $d_{C0}S$ is smaller than the value $d_{Ci}S$. In this case, the polishing start time TiS in the corresponding zone Ci has a negative value.

Next, if necessary, noise reduction is performed by smoothing waveforms of the reference signals obtained with respect to the respective zones as discussed above (STEP 6). Applicable examples of the smoothing method include moving average, a known digital filtering, and polynomial regression. Then, the above-described STEPS 4 to 6 are repeated so as to define the reference signals for all of the zones C1 to C4. At this stage, a time corresponding to each value in the reference signal is corrected in each zone independently, and generally takes a different value. Thus, it is possible to interpolate the reference signals for the respective zones so as to redefine reference signals with an equal time interval and an equal time.

As can be seen from FIG. 12 and the equation (4), the smaller the initial film thickness $d_{Ci}S$, the greater the start point TiS of the reference signal moves to the right in FIG. 12. Further, the larger the end film thickness $d_{Ci}E$, the greater the end point TiE+Δti of the reference signal moves to the left in FIG. 12. Typically, the initial film thickness and the end film thickness vary depending on the zones. Therefore, in the case where the reference signal is determined for each zone, the start point and the end point of the reference signal also vary depending on the zones. Thus, the reference signals are set according to the following process. First, the initial film thicknesses in the respective zones are compared with each other, and a minimum value $\mathrm{Min}(d_{Ci}S)$ of the initial film thicknesses is determined. Similarly, the end film thicknesses in the respective zones are compared with each other, and a maximum value $\mathrm{Max}(d_{Ci}E)$ of the end film thicknesses is determined. Then, the monitoring signals lying only in a section from a time corresponding to the minimum value $\mathrm{Min}(d_{Ci}S)$ to a time corresponding to the minimum value $\mathrm{Max}(d_{Ci}E)$ are assigned as the reference signals. Alternatively, in order to secure a long control time, extrapolation may be performed on the monitoring signals for the respective zones so as to define the reference signals for a longer section.

The reference signals thus obtained for the respective zones are stored in a storage device (e.g., a hard disc) in the monitoring device 53. When polishing the wafer W, the pressing forces of the pressure chambers P1, P2, P3, and P4 against the wafer W are controlled so that the monitoring signals obtained in the respective zones C1 to C4 converge on the reference signals, respectively. In the above-described example, the reference signals are set for the zones C1 to C4 corresponding to the pressure chambers P1, P2, P3, and P4. However, the reference signals may be defined for various zones, other than the zones C1 to C4, on the surface of the wafer W, because the monitoring signals are not limited for the zones C1 to C4 and can be produced for various zones.

According to the embodiment as described above, the reference signals indicating the same film thickness at the same point in time are obtained. The pressures in the pressure chambers P1, P2, P3, and P4 are operated such that the monitoring signals, obtained in the respective zones, converge on the corresponding reference signals. With this operation, a uniform film thickness can be obtained by the polishing process. Therefore, even when the monitoring signal obtained in the peripheral zone of the wafer W is greatly smaller than those obtained in the other zones, a uniform end film thickness can be obtained. Further, since the reference signal is defined for each zone, a desired film-thickness profile, other than a uniform film-thickness profile, can be obtained by further translating the reference signals produced with respect to the temporal axis.

For example, a film-thickness profile having a larger film thickness in the zone Ci than that in the zone C0 by $\Delta d_{Ci}$ is obtained as follows. First, the polishing time ti in the zone Ci is corrected using the above expression (5). Thereafter, the polishing time ti is further corrected using the following expression (5)'.

$$ti \leftarrow ti + \Delta d_{Ci}/R \qquad (5)'$$

In other words, instead of the expression (4), the following expression (4)' is used to correct the polishing time ti.

$$\Delta ti = (d_{C0}S - d_{Ci}S + \Delta d_{Ci})/R \qquad (4)'$$

When the value $\Delta d_{Ci}$ is smaller than zero (i.e., $\Delta d_{Ci} < 0$), the polished film thickness in the zone Ci is smaller than that in the zone C0 by $-\Delta d_{Ci}$.

According to the above corrections, in FIG. 12, the film thickness in the zone Ci at the time TiS (i.e., the start point of the monitoring signal with respect to the zone Ci) can be regarded as being larger than the film thickness in the zone C0 by $\Delta d_{Ci}$. In addition, since the average polishing rates are equal to each other between the zone C0 and the zone Ci, the film thickness in the zone Ci at the arbitrary time TX (in FIG. 12, TiS≦TX≦TE) can also be regarded as being larger than the film thickness in the zone C0 by $\Delta d_{Ci}$. Therefore, by using the thus produced monitoring signals as the reference signals, the film-thickness profile having a larger film thickness in the zone Ci than that in the zone C0 by $\Delta d_{Ci}$ can be obtained by the polishing process. In this case also, the pressing forces are operated during polishing such that the monitoring signals, obtained in the respective zones, converge on the corresponding reference signals.

This embodiment can also be applicable to polishing of a multiplayer structure in which a metal film is formed as an uppermost layer and, beneath the metal film, an insulating layer and interconnects are formed in this order. In this case, a thickness distribution of the insulating film is obtained and then a target profile of the thickness of the polished metal film is determined, whereby polishing can be performed such that heights from the interconnects can be equal to each other. The followings are detailed descriptions each taking example in which polishing is performed for achieving a uniform profile of a polished film.

Figure 13:
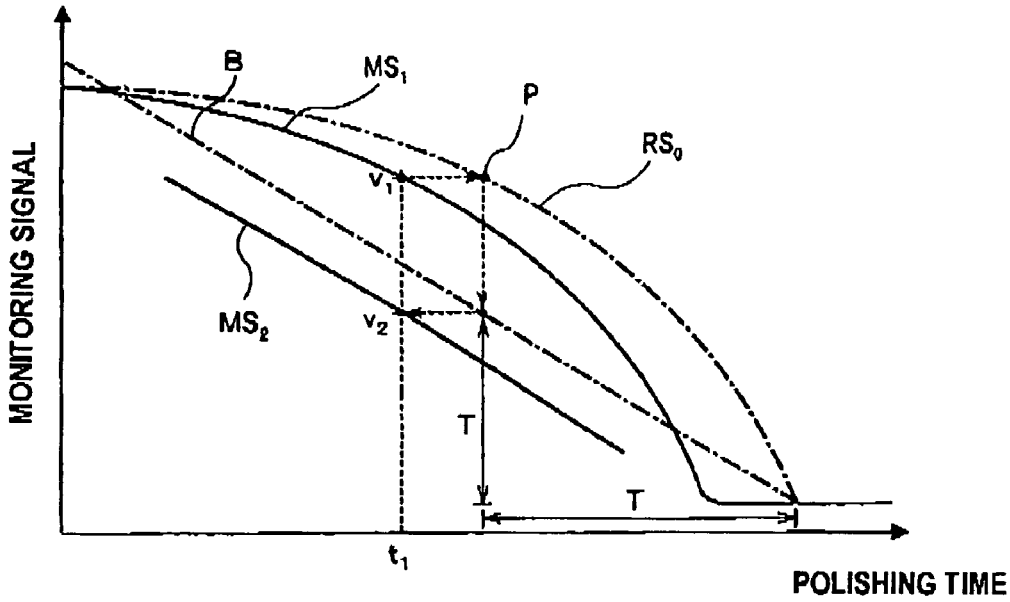
FIG. 13 is a graph illustrating an example of converting the reference signal and the monitoring signal.

FIG. 13 is a graph showing a method of converting a monitoring signal $MS_1$ at a certain zone on a wafer into a new monitoring signal $MS_2$ based on a reference signal $RS_0$ and a straight line B which are set for the monitoring signal $MS_1$. The straight line B passes through a polishing end point of the reference signal $RS_0$ and has a gradient of −1. For example, as shown in FIG. 13, when a value $v_1$ of the monitoring signal $MS_1$ at a time $t_1$ is given, a point P having the same value on the reference signal $RS_0$ is determined. Then, a remaining time T until the polishing end point of the reference signal $RS_0$ is calculated from the time of the point P. As can be seen from FIG. 13, the remaining time T can be calculated by reference to the straight line B. A signal value $v_2$ at the time $t_1$ on the new monitoring signal $MS_2$ is set based on the calculated time T. For example, the signal value $v_2$ is set so that $v_2$=T. Alternatively, the signal value $v_2$ may be normalized by time $T_0$ from a polishing start point to a polishing end point on the reference signal so that $v_2 = T/T_0$. In this case, the straight line B takes a value of 1 at a time 0 and has a gradient of $-1/T_0$.

When a similar process is applied to the reference signal $RS_0$, the aforementioned straight line B can be regarded as a new reference signal for the converted monitoring signal. This new reference signal (straight line B) represents a remaining time from each point to the polishing end point on the reference signal $RS_0$ and thus becomes a monotone decreasing function which is linear with respect to time. Thus, control arithmetic is facilitated.

When the purpose of polishing control is to realize a uniform film-thickness profile, the monitoring signals obtained in the respective zones on the wafer W can be converted in the same manner using reference signals that are set for the monitoring signals, respectively. According to this conversion, the converted monitoring signals are expressed as remaining times before the polishing end point on the corresponding reference signals, or as normalized values of these remaining times. In this case, because the reference signals can be regarded as indicating the same film thickness at the same point in time, the monitoring signals with respect to all zones can be simply compared to each other as indexes of the film thickness. In this case, all of the converted reference signals conform to the straight line B to form a single line.

In most cases, the converted new monitoring signal $MS_2$ is approximately in proportion to a thickness of a film on a surface of a wafer to be polished and thus varies linearly. Accordingly, even if a film thickness value of a wafer to be polished cannot be measured because of a polishing liquid, interconnect patterns on the surface of the wafer, an influence of an underlying layer, and the like, good control performance can be achieved by linear calculation. In the example shown in FIG. 13, the polishing end point on the reference signal $RS_0$ is used as a reference time. However, the reference time on the reference signal $RS_0$ is not limited to the polishing end point. For example, a time at which the reference signal $RS_0$ has a predetermined value may be used as the reference time. The reference time can be set as desired. In particular, when the polishing process is controlled so as to realize a non-uniform film thickness profile as described above, all of the zones do not reach the polishing end point with respect to the reference signals. In this case, a single point on the temporal axis is set as a common reference time for the reference signals that are produced for the respective zones by means of the parallel translation according to the expression (4)'. In this case also, all of the converted reference signals conform to the straight line B to form a single line, as in the case of the uniform profile. Values of a converted new monitoring signal become indeterminate in a certain section in which reference signal values corresponding to monitoring signal values do not exist originally or monitoring signal values do not change according to a polishing time. In such a case, it is possible to stop the control and maintain previous values as set values of the pressing forces of the top ring. In FIG. 13, the reference signal exists until the polishing end point is reached. This is because polishing of the reference wafer is continued until the polishing end point has passed, the polishing end point is detected based on the monitoring signals, and the reference signals are defined such that the film thickness at the polishing end point is zero.

Figure 14:
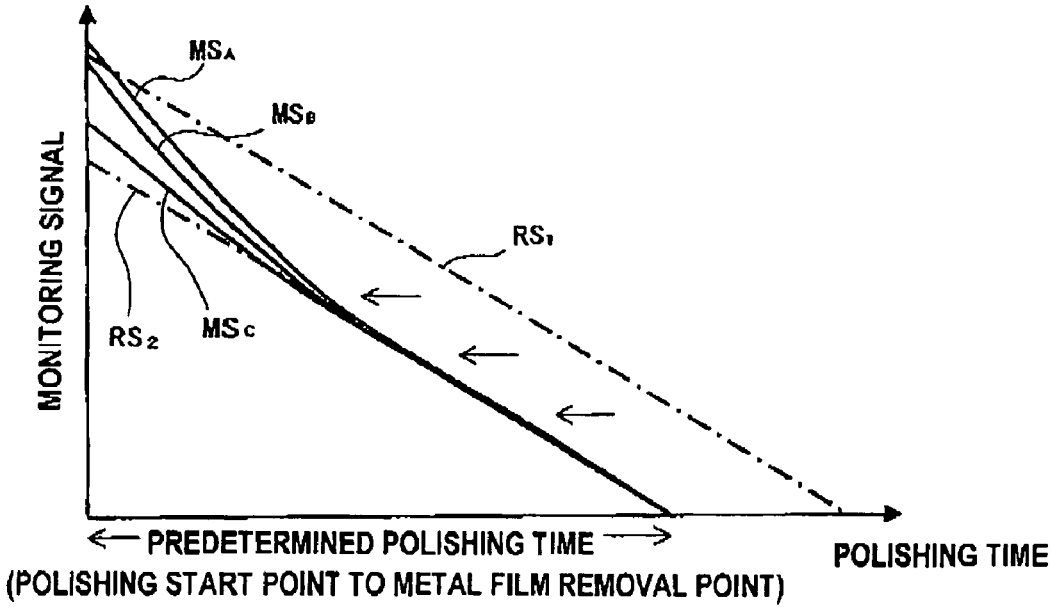
FIG. 14 is a graph illustrating an example of an application method of the reference signal.

FIG. 14 is a graph showing an example of application of the reference signal converted in a manner as described above. In FIG. 14, at the beginning of the polishing process or the control process, a reference signal $RS_1$ is translated in parallel along the temporal axis to generate a new reference signal $RS_2$ so that a polishing time until a polishing end point has a desired value. If the reference signal $RS_1$ has a desired polishing time until the polishing end point at the beginning of the polishing process or the control process, an amount of parallel translation may be zero.

Then, the reference signal $RS_2$ is fixed with respect to the temporal axis. The control process is performed such that the monitoring signals $MS_A$, $MS_B$, and $MS_C$ and a monitoring signal in other unshown zone converge on the reference signal $RS_2$. According to this method, even if the value of the monitoring signal obtained at a certain zone before conversion differs from those at the other zones despite the same film-thickness condition, a uniformity of the film thickness over the surface of the wafer can be improved irrespective of an initial film-thickness profile. Moreover, even if wafers have variations in initial film thickness, or even if the apparatus has variations in conditions such as a polishing pad, a period of time until a polishing end point is expected to be a predetermined value. Thus, if the polishing time can be made constant wafers can be transferred in an approximately constant period, which is predictable, in the polishing apparatus. Accordingly, transfer is not delayed by a wafer that requires a long polishing time, and therefore a throughput can be improved.

Figure 15:
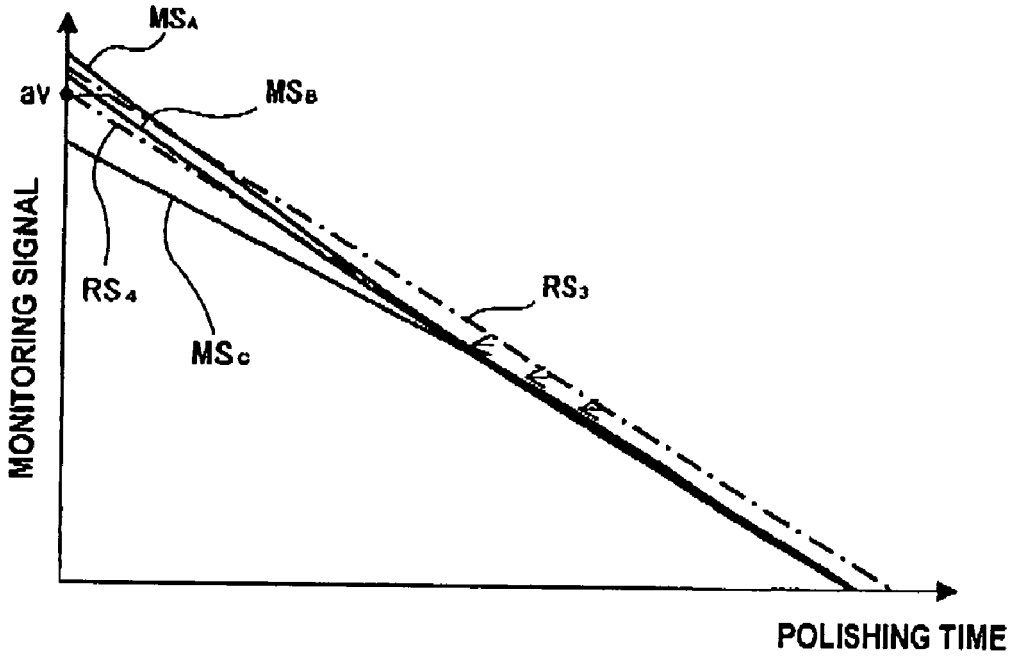
FIG. 15 is a graph illustrating another example of an application method of the reference signal.

FIG. 15 is a graph showing another example of application of a reference signal. In FIG. 15, at the beginning of the polishing process or the control process, a reference signal $RS_3$ is translated in parallel along the temporal axis to generate a new reference signal $RS_4$ so that an averaged value av of monitoring signal values at respective zones is equal to the reference signal. Any method can be employed in obtaining the averaged value of the monitoring signal values as long as it can obtain a value representative of progress of polishing a wafer. For example, a method of calculating an arithmetic mean, a weighted mean, or a method of obtaining a median can be used.

Then, the reference signal $RS_4$ is fixed with respect to the temporal axis. The control process is performed such that the monitoring signals $MS_A$, $MS_B$, and $MS_C$ and the monitoring signal in the other unshown zone converge on the reference signal $RS_4$. According to this method, even if the value of the monitoring signal obtained at a certain zone differs from those at the other zones despite the same film-thickness condition, it is not necessary to excessively change the pressing forces against the zones C1 to C4 of the wafer W, compared with the example shown in FIG. 14. Thus, stable polishing is expected. Further, a polishing time after the beginning of a polishing process or a control process is expected to be equal to a polishing time when a wafer having the same film thickness is polished to generate a reference signal. The uniformity of the film thickness in the polished surface can be improved irrespective of an initial film thickness profile. Simultaneously, an averaged polishing rate can be achieved irrespective of conditions of the apparatus such as a polishing pad.

Figure 16:
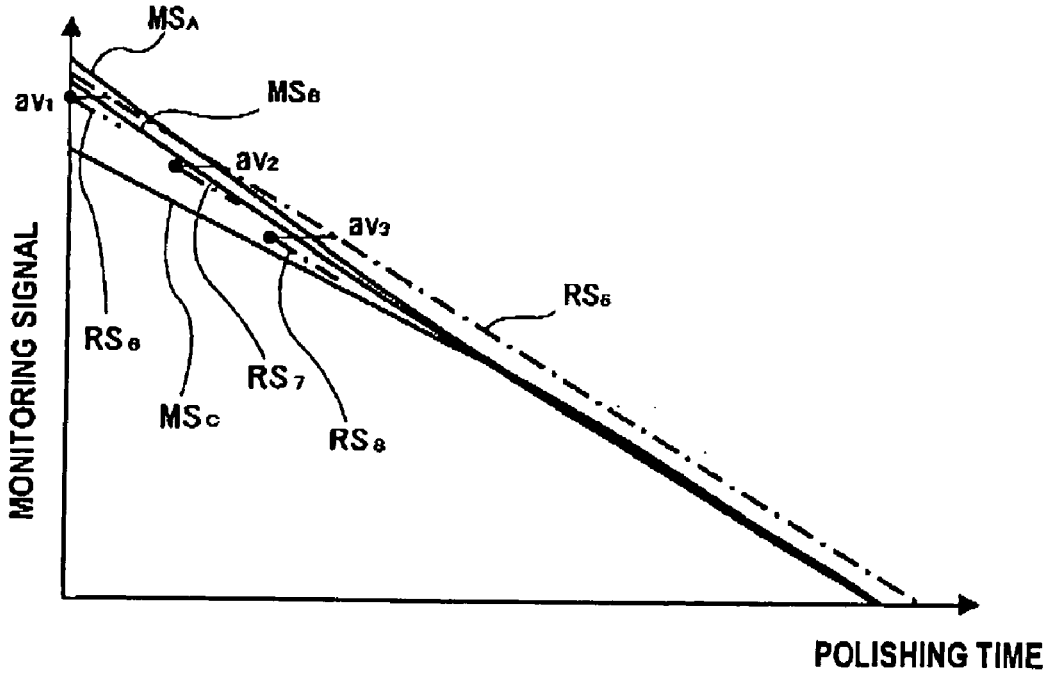
FIG. 16 is a graph illustrating another example of an application method of the reference signal.

FIG. 16 is a graph showing still another example of application of a reference signal. In FIG. 6, a reference signal $RS_5$ is translated in parallel along the temporal axis in a predetermined period so that an averaged value of monitoring signals at the respective zones is equal to the reference signal $RS_5$. For example, the reference signal $RS_5$ is translated in parallel so as to be equal to averaged values $av_1$, $av_2$, and $av_3$ of monitoring signals to thereby generate new reference signals $RS_6$, $RS_7$, and $RS_8$, respectively. Then, the pressing forces against the zones C1 to C4 of the wafer are controlled such that the monitoring signals, obtained in the respective zones, converge on the reference signals generated by translation from moment to moment. This method can also be applicable to the case where the value of the monitoring signal obtained at a certain zone differs from those at the other zones despite the same film-thickness condition. Specifically, in a case where initial pressing forces applied to the zones C1 to C4 of the wafer are approximately within a reasonable range, if a pressing force to be applied to a certain zone is increased at a certain point of time, a pressing force to be applied to another zone is decreased. Accordingly, the present embodiment can achieve stable polishing with small variations of manipulated variables, although this embodiment does not have a function to adjust a polishing time or a polishing rate. Further, an excellent uniformity of the film thickness can be achieved over the surface of the wafer, irrespective of an initial film thickness profile.

Further, in such a case, a blanket wafer may be used as the reference wafer so as to produce the reference signals for use in control of polishing of a patterned wafer. In this case also, a good result can be obtained. The blanket wafer is a wafer on which at least one type of material is formed with a uniform film thickness and so-called patterns are not formed. Generally, in polishing of a patterned wafer, a polishing rate changes when a surface of the wafer is planarized, unlike the blanket wafer. Further, in the case where the film to be polished is a metal film and the eddy current sensor is used, a rate of change in the monitoring signal indicating the film thickness also changes when the surface of the wafer is planarized. However, the purpose of the above-described method is to control the film-thickness profile, and this method does not have a function to adjust the polishing rate. Therefore, a good control capability can be achieved, irrespective of the difference in the polishing rate and the rate of change in the monitoring signal.

In a patterned wafer, it is difficult to measure a film thickness when a film is thin. In addition, it is troublesome to produce the reference signals by polishing a product wafer (i.e., an object to be polished) in advance every time a type of product wafer changes. Moreover, this way of producing the reference signals wastes the product wafer. Thus, it makes a lot of sense from a practical viewpoint to control polishing of the patterned wafer by applying the reference signals produced from the blanket wafer.

In FIGS. 15 and 16, the reference signal is translated in parallel at the beginning of the polishing process or in a predetermined period so as to be equal to averaged values of the monitoring signals. However, the reference signal may be translated in parallel based on any value other than averaged values of the monitoring signals. For example, a reference signal may be translated in parallel based on a monitoring signal obtained in a predetermined zone on a wafer. Specifically, the reference signal may be translated in parallel at the beginning of the polishing process so as to be equal to the monitoring signal in the predetermined zone at that time. The reference signal may also be translated in parallel during the polishing process so as to be equal to the monitoring signal in the predetermined zone at that time.

As described above, the reference wafer is appropriately determined and the reference signals are defined for the target wafer to be polished. During polishing, the pressing forces are operated based on the reference signals. Therefore, the film-thickness profile can be easily controlled without troublesome operations of continuously establishing a relationship between each monitoring signal for each zone and the film thickness during polishing.

Figure 17:
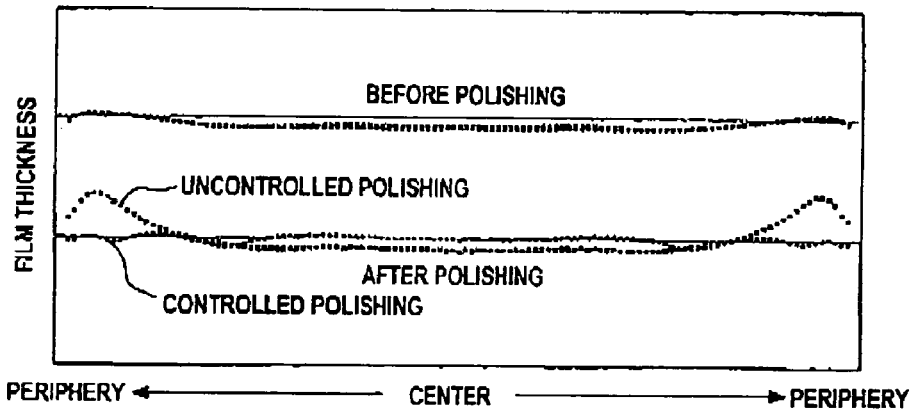
FIG. 17 is a graph showing film-thickness distributions in a radial direction of a wafer before and after polishing in the case of producing the reference signals.

FIG. 17 is a graph showing film-thickness distributions along the radial direction of the wafer obtained before and after polishing of the wafer. In this example, polishing was performed so as to realize a uniform film-thickness profile, using the reference signals produced by the method according to the embodiment. In controlled polishing (i.e., the polishing method according to the embodiment of the present invention), pressing forces were operated such that the monitoring signals, obtained at the respective zones, converged on the respective reference signals. On the other hand, in uncontrolled polishing, pressing forces against the wafer were set to be equal to initial pressing forces in the controlled polishing, and were kept constant during polishing. It can be seen from FIG. 17 that an excellent uniformity in the film thickness over the surface, including the peripheral zone, of the wafer can be obtained.

Figure 18:
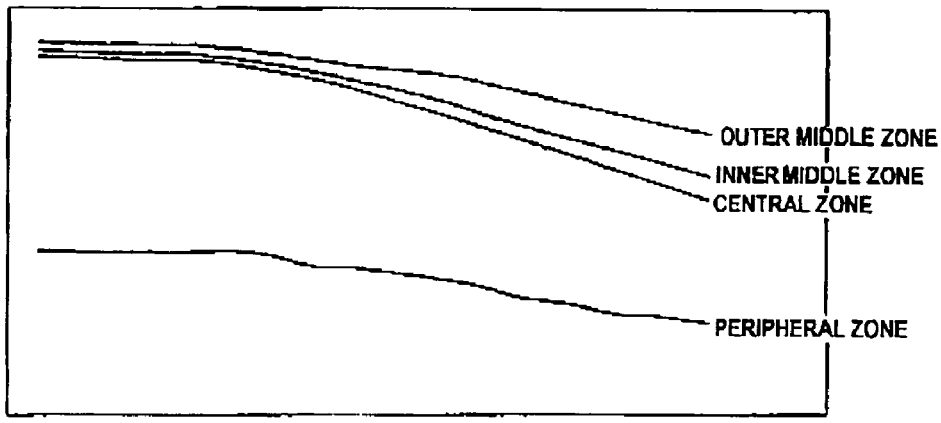
FIG. 18 is a graph showing the monitoring signals in the case of uncontrolled polishing.
Figure 19:
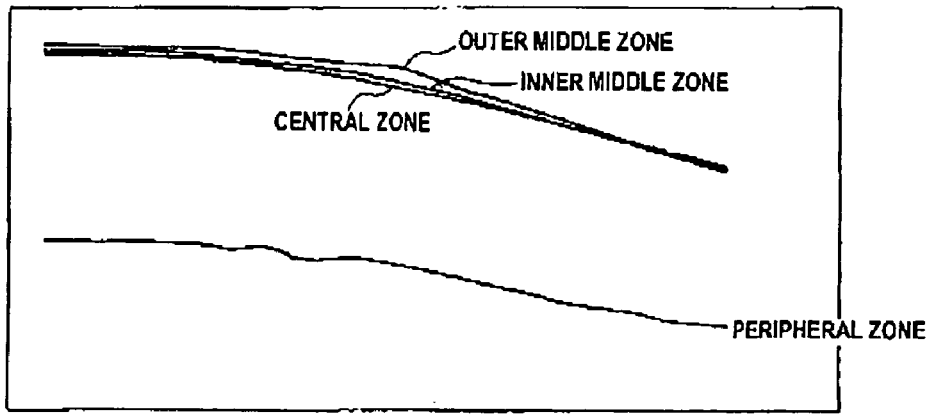
FIG. 19 is a graph showing the monitoring signals in the case of controlled polishing.

FIG. 18 is a graph showing changes in the monitoring signals in the case of the uncontrolled polishing, and FIG. 19 is a graph showing changes in the monitoring signals in the case of the controlled polishing. As shown in FIG. 18, in the uncontrolled polishing, the monitoring signals, obtained at the three zones (i.e., the central zone, the inner middle zone, the outer middle zone) on the surface of the wafer, differ from each other. In contrast, in the controlled polishing, as can be seed from FIG. 19, the monitoring signals converge substantially on a single value. With regard to the peripheral zone of the wafer, the monitoring signal is greatly different from the monitoring signals obtained in the other zones for the reasons as described previously. Accordingly, it is not possible to visually confirm the convergence from the graph. However, actually, the polishing control in the peripheral zone of the wafer is performed according to the corrected reference signal. Therefore, a uniform film thickness can be obtained in all zones including the peripheral zone, as shown in FIG. 17.

Figure 20:
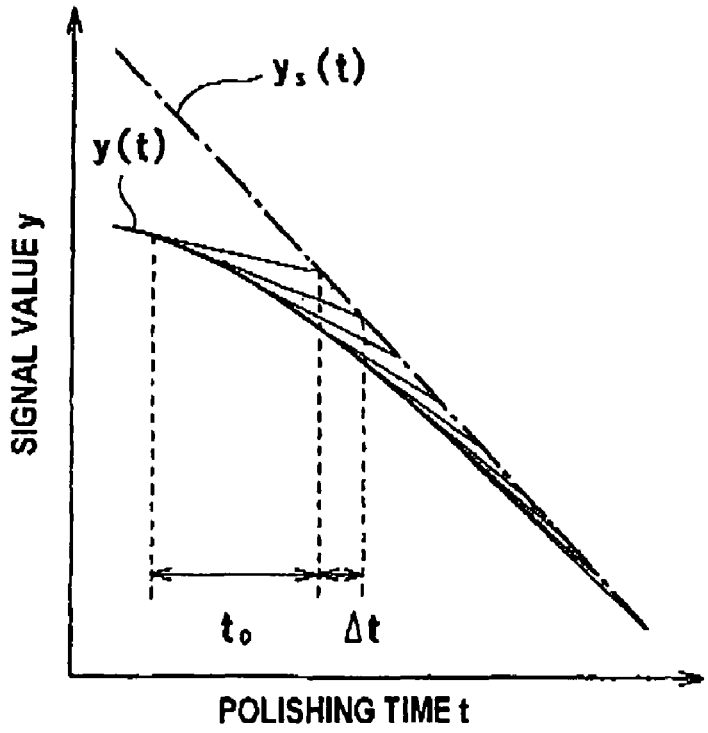
FIG. 20 is a graph explanatory of a predictive fuzzy control.

FIG. 20 is a graph explanatory of a control arithmetic method according to the present invention. The conversion method for monitoring signals which has been described with reference to FIG. 13 is applied to FIG. 20. A new reference signal ys(t) at a time t after the polishing start point is represented by the following equation (X).

$$ys(t)=T_0-t \tag{6}$$

In the equation (6), $T_0$ represents a period of time from the polishing start point to the polishing end point on the reference signal.

Let $T_0$ be the time corresponding to the reference signal which has been translated in parallel along the temporal axis according to either one of former two of the aforementioned three methods (see FIGS. 14 and 15). Alternatively, if the reference signal has been translated in parallel along the temporal axis according to the method as shown in FIG. 16, the right side of the equation will be an averaged value of monitoring signals in the respective zones at that time. In all the cases, at that time, a predicted value $y_p(t, t_o)$ of the monitoring signal in each zone after a predetermined period of time $t_0$ has elapsed from the time t is given by the following equation (7).

$$y_p(t,t_o)=y(t)+t_o\cdot\{y(t)-y(t-\Delta t_m)\}/\Delta t_m \tag{7}$$

In the equation (7), y(t) represents a monitoring signal at the time t, and $\Delta t_m$ represents a predetermined period of time for calculating a gradient of the monitoring signal with respect to time variations.

A discordance $D(t, t_o)$ of the predicted value of the monitoring signal after the time $t_o$ has elapsed from the time t with respect to the reference signal is defined by the following equation (8).

$$D(t,t_o)=-\{y_p(t,t_o)-y_s(t+t_o)\}/t_o \tag{8}$$

When the discordance D represented by the equation (8) is positive, the monitoring signal tends to lead before the reference signal. Negative discordance means that the monitoring signal tends to lag behind the reference signal.

Figure 21:
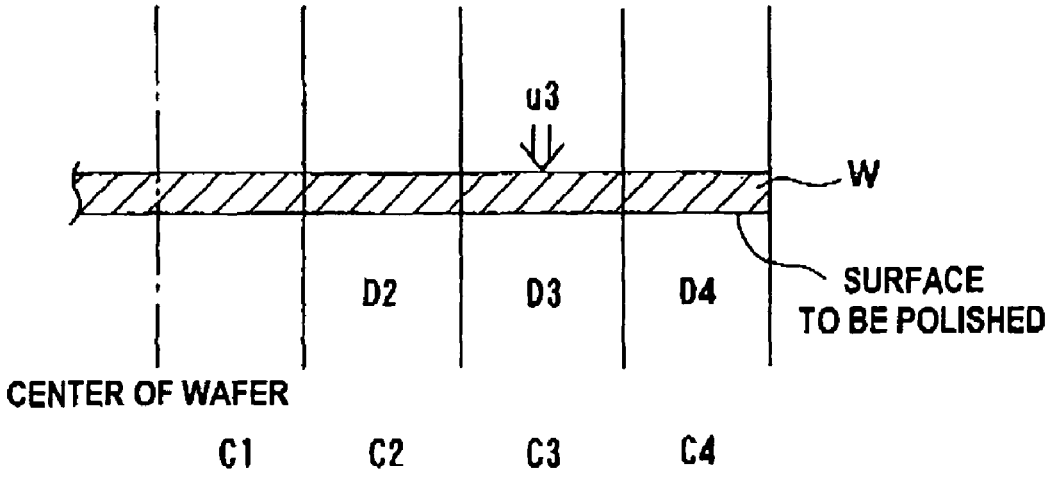
FIG. 21 is a schematic view illustrating the predictive control.
Figures 22, 23, 24:
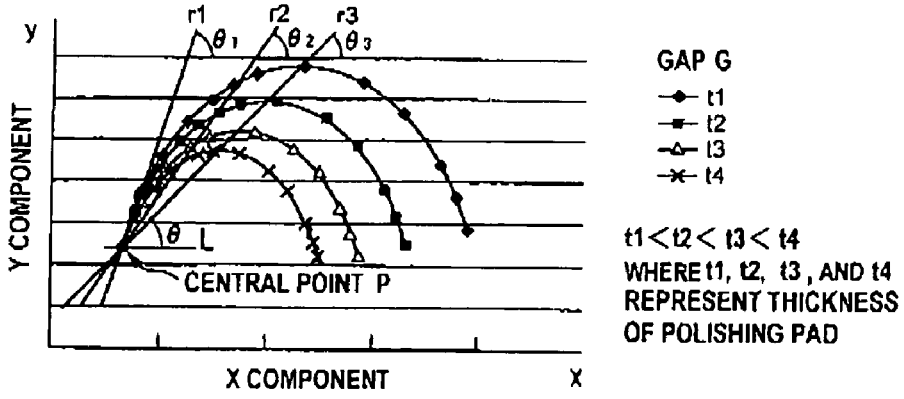
FIG. 22 is a table showing an example of fuzzy rules for the predictive control.
FIG. 23 is a table showing another example of fuzzy rules for the predictive control.
FIG. 24 is a view showing a change in circular locus on an impedance coordinate system according to a change in gap (i.e., a pad thickness) between a conductive film and a sensor coil.

As shown in FIG. 20, where the reference signal is expressed as a linear line, if predicted values of the monitoring signal are always equal to the reference signal at time t of a period (cycle) Δt, then the monitoring signal is expected to asymptotically converge on the reference signal. For example, as shown in FIG. 21, D3 is defined as a discordance of the zone C3 of the wafer having a reverse face to which a pressing force u3 is applied, and D2 and D4 are respectively defined as discordances of the zones C2 and C4 of the wafer which are adjacent to the zone C3. Variation Δu3 of the pressing force u3 is determined as follows. FIG. 22 shows an example of fuzzy rules to determine variation Δu3 of the pressing force u3. FIG. 23 shows an example of fuzzy rules in consideration of a temperature $T_p$ of a local point of the polishing pad immediate after sliding contact with the wafer, in addition to the fuzzy rules shown in FIG. 22. In FIGS. 22 and 23, "S" means low, and "B" means high. Further, "PB" means to be largely increased, "PS" means to be slightly increased, "ZR" means to be fixed, "NS" means to be slightly decreased, and "NB" means to be largely decreased.

As shown in the fuzzy rules of FIG. 22, variation Δu3 of the pressing force is made larger as the discordance D3 of the corresponding zone C3 is lower or the pressing force u3 is smaller. Further, variation Δu3 is adjusted so as to be increased when the discordances D2 and D4 of the adjacent zones C2 and C4 are lower. Fuzzy rules can be determined in a similar manner for pressing forces applied to other independent areas, discordances of these zones, and variations of the pressing forces. Thus, pressing forces can be controlled without excessively large or small values so that all discordances converge on zero.

In most cases, as a polishing pad has a higher temperature, a polishing rate is increased, so that the temperature of the polishing pad tends to be further increased. Accordingly, in the example shown in FIG. 23, the lower the temperature $T_p$ of the polishing pad, the larger the variation Δu3 of the pressing force u3 is set. On the other hand, the higher the temperature $T_p$ of the polishing pad, the smaller the variation Δu3 of the pressing force u3 is set.

Fuzzy rules which can be applied to the present invention are not limited to examples shown in FIGS. 24 and 25. Fuzzy rules can be defined according to properties of the system as desired. Further, membership functions of antecedent variables and consequent variables can be defined as desired. Any inference methods such as a logical multiplication method, an implication method, an aggregation method, and a defuzzification method can be selected as desired. For example, the variation Δu3 of the pressing force can be adjusted by appropriately setting the membership function of the consequent. It is possible to provide a constraint on upper and lower limits to the thus obtained pressing force u3 and the variation Δu3. Further, the zones where the monitoring signals or the discordances are defined are not limited to the above-described zones C1 to C4. For example, one or two zone may be added to the boundaries between the zones C1 to C4, so that more detailed control can be performed.

In the above examples, when the original reference signal and the monitoring signal are linearly approximated to a certain degree with respect to time, the conversion from the monitoring signal to the value associated with the polishing time as described with reference to FIG. 13 is not necessarily needed. If a graph describing the change in the monitoring signal with time has a small curvature, the method as described in FIG. 20 can be used. Specifically, if the predicted value of the monitoring signal coincides with the reference signal ys(t) after the elapse of the time to which is calculated by the equation (7), the monitoring signal gradually comes close to the reference signal. Therefore, a good control can be performed. When the conversion from the monitoring signal to the value associated with the polishing time is not performed, the reference signal is translated in a manner as described in FIG. 15 or FIG. 16. In this case, an average of the monitoring signals in the zones, other than a zone including the peripheral zone or a zone where the monitoring signal shows a greatly different value under the influence of a SUS component, is calculated, and the resultant average can be used as a basis of the parallel translation.

In the above examples, a predictive fuzzy control is used. In this control method, predicted values of discordances are calculated for inference. Many steps are required from the time when the sensor captures information of the surface of the wafer to the time when actual pressing forces are completely replaced with new values to change polishing conditions so that output values of the sensor are completely changed. For example, there are required many steps including transfer of the output signal from the sensor to the monitoring unit, conversion into the monitoring signal and smoothing the monitoring signal, calculation of the pressing force, transfer to the controller, command to the pressure-adjusting device, and operation of the pressing mechanism (pressure chambers). Accordingly, one or two seconds to about 10 seconds are required until signal waves completely reflect changes of the manipulated variables. Thus, the predictive control is effective in performing the control process with a reduced influence of response lag.

The predictive control method is not limited to the aforementioned fuzzy control. For example, a model predictive control, which defines a proper mathematical model, may be used. When modeling is conducted including the above response lag, further improvement of control performance is expected. In such a system, when the control period is short, a subsequent operation may nonsensically be conducted before the monitoring signal fully reflects changes of the manipulated variables. Further, unnecessary changes of the manipulated variables and variations of the signals may be caused. A polishing time is generally from several tens of seconds to several hundreds of seconds. Accordingly, if the control period is excessively long, a polishing end point is reached before a desired uniform profile is achieved. Therefore, it is desirable that the control period be in a range of 1 second to 10 seconds.

When polishing a wafer while operating the pressing forces, the polishing end point (including a point of switching polishing conditions) can be determined by detecting a point of time when the metal film is removed based on the monitoring signal or when the monitoring signal reaches a predetermined threshold.

The above-described reference signals may be defined only for two zones: the zone C1 (the central zone of the wafer) and the zone C4 (the peripheral zone of the wafer). In this case, the reference signal for the zone C1 is used in polishing control in the zone C1 and the zones C2 and C3 (the inner middle zone and the outer middle zone). Preferably, the reference signals are defined for all zones of the surface of the wafer and the reference signals, corresponding to the respective zones, are used during polishing, as described above. This method can eliminate not only an influence of the change in the monitoring signal at the peripheral zone of the wafer, but also an influence of a conductive or magnetic component (e.g., SUS flange) in the top ring that can affect the monitoring signals obtained by the eddy current sensor. As a result, a good control capability can be obtained.

In the processes of defining the reference signals, the scaling and the parallel translation of the monitoring signals are performed on the assumption that the polishing rates in the respective zones are constant during polishing of the reference wafer. When the polishing time is sufficiently long and the initial film thickness and the polishing rates do not vary greatly between the zones, the amounts of the scaling and the parallel translation are small. In this case, the grasp of the film-thickness profile based on the monitoring signals is not impaired in a practical sense.

While the monitoring signal is monotonously decreased as the polishing progresses in the above-described embodiment, the present invention can be applicable to a case where the monitoring signal is monotonously increased. For example, in a case of using an impedance-type eddy current sensor as the sensor 50, the following method, disclosed in Japanese laid-open patent publication No. 2005-121616, can be applied.

As shown in FIG. 1, the conductive film on the surface of the wafer W is measured by the sensor (eddy current sensor) 50, embedded in the polishing table 12, through the polishing pad 10. In this case, a gap between the sensor 50 and the conductive film changes according to a thickness of the polishing pad 10 lying therebetween. As a result, for example, as shown in FIG. 24, arc loci of a signal component X and a signal component Y change according to gaps G formed by the polishing pad 10 with a thickness of t1, t2, t3, or t4. Thus, in order to accurately measure the film thickness of the conductive film on the semiconductor wafer W based on the arc loci of the signal component X or the signal component Y, it is necessary to prepare measurement information about the signal component X and the signal component Y at known film thicknesses of the conductive film for each thickness of the polishing pad. Such measurement information may be prepared each time a polishing pad is replaced with a new one. After preparation of the measurement information, the film thickness of the conductive film is measured.

In the measuring results of the signal component X and the signal component Y by the eddy current sensor, as shown in FIG. 24, values of the signal components X and Y at the same film thickness of the conductive film are connected by lines ($r_1$, $r_2$, $r_3$). The lines ($r_1$, $r_2$, $r_3$) intersect each other at an intersection (central point) P without regard to the gaps G between an upper end of a sensor coil and the conductive film. In this manner, the central point P can be obtained from the signal components X and Y. Each of these preliminary measurement lines rn (n=1, 2, 3 . . . ) is inclined at an elevation angle θ with respect to a base line L (horizontal line in FIG. 24), which passes through the intersection P and has a constant value of the signal component Y. The elevation angle θ varies depending on the film thickness of the conductive film.

Accordingly, even if the thickness of the polishing pad used for polishing the conductive film of the semiconductor wafer W is unknown, the film thickness of the conductive film can be calculated based on correlation of variation trend of elevation angles θ which has previously been measured according to the film thicknesses of the conductive film. Specifically, the central point P and a point having output values (measuring result) of the signal components X and Y with respect to the conductive film are connected by the measurement line rn. When an elevation angle θ of the measurement line rn with respect to the base line L is obtained, the film thickness of the conductive film can be calculated based on the elevation angle θ. However, in order to control the uniformity of the film thickness, an absolute value of the film thickness is not necessarily required. It is only necessary to obtain a relative film thickness along the radial direction of the wafer W. Therefore, the elevation angle θ can be simply used as the monitoring signal. The base line L may be a vertical line having a constant value of a reactance component X in FIG. 24.

INDUSTRIAL APPLICABILITY

The present invention is applicable to a polishing apparatus and a polishing method for polishing a substrate, such as a semiconductor wafer, to planarize the substrate.

The invention claimed is:

1. A polishing apparatus for polishing a substrate having a film formed on a surface thereof, said apparatus comprising:

a polishing table having a polishing surface;

a top ring configured to press the substrate against said polishing table by applying pressing forces independently to first plural zones on the substrate;

a sensor configured to detect a state of the film at plural measuring points;

a monitoring device configured to produce monitoring signals for second plural zones on the substrate, respectively, from an output signal of said sensor;

a storage device configured to store plural reference signals each indicating a relationship between reference values of each monitoring signal and polishing times, the plural reference signals corresponding to the second plural zones, respectively; and a controller configured to control the pressing forces applied to the first plural zones such that the monitoring signals, corresponding respectively to the second plural zones, converge on the corresponding reference signals, respectively.

2. The polishing apparatus according to claim 1, wherein:

one of the second plural zones is a zone including a peripheral zone of the substrate; and one of the plural reference signals is a reference signal with respect to the zone including the peripheral zone of the substrate.

3. The polishing apparatus according to claim 1, wherein values of the monitoring signals and values of the reference signals are converted into values associated with a polishing time based on the reference signals so that new monitoring signals and new reference signals are produced.

4. The polishing apparatus according to claim 3, wherein an average of the new monitoring signals with respect to the second plural zones is calculated at a certain time in polishing of the substrate, and the new reference signal after that time is translated along a temporal axis such that the new reference signal at that time coincides with the average.

5. The polishing apparatus according to claim 1, wherein the plural reference signals correspond to the same film thickness at the same point in time.

6. The polishing apparatus according to claim 1, wherein the plural reference signals correspond to film thicknesses each reflecting a predetermined film-thickness difference between the second plural zones.

7. The polishing apparatus according to claim 1, wherein a control period of said controller is in a range of 1 second to 10 seconds.

8. The polishing apparatus according to claim 1, wherein said sensor comprises an eddy current sensor.

9. The polishing apparatus according to claim 1, wherein said controller is configured to detect a polishing end point based on at least one of the monitoring signals produced by said monitoring device.

10. A polishing method for polishing a substrate having a film formed on a surface thereof by applying pressing forces independently to first plural zones on the substrate to press the substrate against a polishing table, said method comprising:

detecting a state of the film at plural measuring points using a sensor;

from an output signal of the sensor, producing monitoring signals for second plural zones on the substrate, respectively;

defining plural reference signals each indicating a relationship between reference values of each monitoring signal and polishing times, the plural reference signals corresponding to the second plural zones, respectively;

storing the plural reference signals on a storage device; and controlling the pressing forces applied to the first plural zones such that the monitoring signals, corresponding respectively to the second plural zones, converge on the corresponding reference signals, respectively.

11. The polishing method according to claim 10, wherein: one of the second plural zones is a zone including a peripheral zone of the substrate; and one of the plural reference signals is a reference signal with respect to the zone including the peripheral zone of the substrate.

12. The polishing method according to claim 10, wherein the plural reference signals are obtained by polishing a blanket wafer.

13. The polishing method according to claim 10, wherein the plural reference signals correspond to the same film thickness at the same point in time.

14. The polishing method according to claim 13, wherein said defining of the plural reference signals comprises: preparing a reference substrate equivalent to the substrate to be polished; measuring a thickness of a film on the reference substrate; during polishing of the reference substrate, detecting a state of the film on the reference substrate at the plural measuring points by the sensor; from the output signal of the sensor, producing monitoring signals for a first zone and a second zone selected from the second plural zones; stopping polishing of the reference wafer when the film in the first zone and the second zone is completely removed; calculating average polishing rates in the first zone and the second zone; expanding or compressing the monitoring signal for the second zone along a temporal axis such that the average polishing rate in the second zone is equal to the average polishing rate in the first zone; calculating a polishing time required for aligning an initial film thickness in the second zone with an initial film thickness in the first zone; translating the expanded or compressed monitoring signal for the second zone along the temporal axis by the polishing time calculated; and assigning the translated monitoring signal as a reference signal for the second zone.

15. The polishing method according to claim 10, wherein the plural reference signals correspond to film thicknesses each reflecting a predetermined film-thickness difference between the second plural zones.

16. The polishing method according to claim 15, wherein said defining of the plural reference signals comprises:

preparing a reference substrate equivalent to the substrate to be polished;

measuring a thickness of a film on the reference substrate;

during polishing of the reference substrate, detecting a state of the film on the reference substrate at the plural measuring points by the sensor;

from the output signals of the sensor, producing monitoring signals for a first zone and a second zone selected from the second plural zones;

measuring a thickness of the film on the reference substrate after polishing thereof;

calculating average polishing rates in the first zone and the second zone; expanding or compressing the monitoring signal for the second zone along a temporal axis such that the average polishing rate in the second zone is equal to the average polishing rate in the first zone;

calculating a first polishing time required for aligning an initial film thickness in the second zone with an initial film thickness in the first zone;

calculating a second polishing time required for providing the predetermined film-thickness difference between the initial film thickness in the second zone and the initial film thickness in the first zone;

translating the expanded or compressed monitoring signal for the second zone along the temporal axis by a sum of the first polishing time and the second polishing time; and assigning the translated monitoring signal as a reference signal for the second zone.

* * * * *